US007134367B2

(12) United States Patent
Gehring et al.

(10) Patent No.: US 7,134,367 B2
(45) Date of Patent: Nov. 14, 2006

(54) FASTENER FEEDING SYSTEM

(75) Inventors: Todd M. Gehring, Hartland, WI (US); Peter B. Lane, Mequon, WI (US); Tom J. Edwards, Lisbon, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 84 days.

(21) Appl. No.: 10/730,745

(22) Filed: Dec. 8, 2003

(65) Prior Publication Data

US 2004/0139822 A1 Jul. 22, 2004

Related U.S. Application Data

(60) Provisional application No. 60/492,426, filed on Aug. 4, 2003, provisional application No. 60/431,917, filed on Dec. 9, 2002.

(51) Int. Cl.
*B25B 23/04* (2006.01)

(52) U.S. Cl. ..... 81/434; 81/57.37

(58) Field of Classification Search ..... 81/434, 81/57.37, 57.44; 173/157, 159
See application file for complete search history.

(56) References Cited

U.S. PATENT DOCUMENTS

| | | | |
|---|---|---|---|
| 2,202,240 | A | 5/1940 | Trotter |
| 2,538,350 | A | 1/1951 | Baule |
| 2,646,091 | A | 7/1953 | Austin |
| 3,460,408 | A | 8/1969 | Raymond |
| 3,554,246 | A | 1/1971 | Halstead |
| 3,601,168 | A | 8/1971 | Fernstrom |
| 3,757,407 | A | 9/1973 | Bomar |
| 3,854,648 | A | 12/1974 | Inzoli et al. |
| 3,910,124 | A | 10/1975 | Halsey |
| 3,910,324 | A | 10/1975 | Nasiatka |
| 3,930,297 | A | 1/1976 | Potucek et al. |
| 4,014,225 | A | 3/1977 | Lejdegard et al. |
| 4,018,254 | A | 4/1977 | DeCaro |
| 4,059,034 | A | 11/1977 | Hornung |
| 4,062,389 | A | 12/1977 | Lejdegard |
| 4,146,071 | A | 3/1979 | Mueller et al. |
| 4,287,923 | A | 9/1981 | Hornung |
| 4,404,877 | A | 9/1983 | Mizuno et al. |
| 4,428,261 | A | 1/1984 | Takatsu et al. |
| 4,517,863 | A | 5/1985 | Ishikawa |

(Continued)

FOREIGN PATENT DOCUMENTS

| | | |
|---|---|---|
| DE | 3808534 | 9/1989 |

(Continued)

*Primary Examiner*—Lee D. Wilson
(74) *Attorney, Agent, or Firm*—Michael Best & Friedrich LLP

(57) ABSTRACT

A fastener feeding device may include a housing that is securable to a power tool, a glider assembly that is slidably coupled to the housing, a depth control nose slidably coupled to the glider assembly and the housing, and a locking member pivotally coupled to the glider. The locking member may include a mounting sleeve coupleable to a power tool for providing a quick release connection of the feeding device to the power tool. A depth stop may be coupled to the mounting sleeve and may be engageable with a depth stop adjusting ring to adjust a depth to which a fastener driven by the system is driven relative to a surface of a workpiece. A depth control locking member may be pivotally coupled to the glider assembly for adjusting the depth nose control nose with respect to the glider assembly. An extension may be connectable between the power tool and the feeding device.

31 Claims, 43 Drawing Sheets

U.S. PATENT DOCUMENTS

| | | | | |
|---|---|---|---|---|
| 4,592,257 | A | | 6/1986 | Durr |
| 4,619,393 | A | | 10/1986 | Maurer |
| 4,667,545 | A | | 5/1987 | Gould, Jr. et al. |
| 4,674,367 | A | | 6/1987 | Aab et al. |
| 4,753,142 | A | | 6/1988 | Hornung |
| 4,774,863 | A | | 10/1988 | Geist |
| 4,784,026 | A | | 11/1988 | Kobayashi et al. |
| 4,793,226 | A | | 12/1988 | Kress |
| 4,807,498 | A | | 2/1989 | Kleiser et al. |
| 4,930,630 | A | | 6/1990 | Habermehl |
| 4,936,169 | A | | 6/1990 | Parsons |
| 5,012,708 | A | | 5/1991 | Martindell |
| 5,027,679 | A | | 7/1991 | Kawashima et al. |
| 5,083,483 | A | | 1/1992 | Takagi |
| 5,101,697 | A | | 4/1992 | Fishback |
| 5,109,738 | A | | 5/1992 | Farian et al. |
| 5,138,913 | A | | 8/1992 | Chen |
| 5,144,870 | A | | 9/1992 | Nick |
| 5,167,174 | A | | 12/1992 | Fujiyama et al. |
| 5,186,085 | A | | 2/1993 | Monacelli |
| 5,224,803 | A | | 7/1993 | Lallier |
| 5,231,900 | A | | 8/1993 | Deri |
| 5,239,900 | A | | 8/1993 | Macris |
| 5,337,635 | A | | 8/1994 | Habermehl |
| 5,339,713 | A | | 8/1994 | Hou |
| 5,341,706 | A | | 8/1994 | Takagi |
| 5,351,586 | A | | 10/1994 | Habermehl et al. |
| 5,402,695 | A | | 4/1995 | Hornung |
| 5,408,903 | A | | 4/1995 | Ramin |
| 5,469,767 | A | | 11/1995 | Habermehl |
| 5,473,965 | A | | 12/1995 | Chen |
| 5,509,330 | A | | 4/1996 | Nick |
| 5,531,142 | A | | 7/1996 | Adamo |
| 5,531,143 | A | | 7/1996 | Habermehl et al. |
| 5,568,753 | A | | 10/1996 | Habermehl et al. |
| 5,570,618 | A | | 11/1996 | Habermehl et al. |
| 5,584,221 | A | | 12/1996 | Petrantoni |
| D383,656 | S | | 9/1997 | Muro |
| 5,671,645 | A | | 9/1997 | Murayama et al. |
| 5,687,624 | A | | 11/1997 | Tsuge et al. |
| 5,699,704 | A | | 12/1997 | Habermehl |
| 5,758,768 | A | | 6/1998 | Habermehl et al. |
| 5,791,207 | A | | 8/1998 | Ahdoot |
| 5,839,332 | A | | 11/1998 | Fujiyama et al. |
| 5,855,151 | A | | 1/1999 | Habermehl |
| 5,862,724 | A | * | 1/1999 | Arata et al. ..... 81/434 |
| 5,870,933 | A | | 2/1999 | Habermehl et al. |
| 5,884,541 | A | | 3/1999 | Habermehl et al. |
| 5,890,405 | A | | 4/1999 | Becker |
| 5,899,126 | A | * | 5/1999 | Fujiyama et al. ..... 81/434 |
| 5,904,079 | A | | 5/1999 | Tsuge et al. |
| 5,927,163 | A | | 7/1999 | Habermehl et al. |
| 5,931,366 | A | | 8/1999 | Muro |
| 5,934,162 | A | | 8/1999 | Habermehl |
| 5,943,926 | A | | 8/1999 | Habermehl |
| 5,974,918 | A | | 11/1999 | Nakagawa et al. |
| 5,988,025 | A | | 11/1999 | Sasaki et al. |
| 5,988,026 | A | | 11/1999 | Reckelhoff et al. |
| 6,055,891 | A | | 5/2000 | Habermehl |
| 6,073,523 | A | | 6/2000 | Shinjo |
| 6,089,132 | A | | 7/2000 | Habermehl |
| 6,138,535 | A | | 10/2000 | Jalbert et al. |
| 6,138,536 | A | | 10/2000 | Chen |
| 6,145,725 | A | | 11/2000 | Omli |
| 6,164,170 | A | | 12/2000 | Habermehl et al. |
| 6,170,366 | B1 | | 1/2001 | Jalbert et al. |
| 6,186,035 | B1 | | 2/2001 | Jalbert et al. |
| 6,212,980 | B1 | | 4/2001 | Kratch et al. |
| 6,230,594 | B1 | | 5/2001 | Jalbert et al. |
| 6,244,140 | B1 | | 6/2001 | Habermehl |
| 6,296,166 | B1 | | 10/2001 | Huang |
| 6,453,780 | B1 | | 9/2002 | Habermehl |
| 6,647,836 | B1 | | 11/2003 | Habermehl |
| 6,769,332 | B1 | | 8/2004 | Muro |
| 6,945,140 | B1 | | 9/2005 | Gibbons et al. |
| 2002/0043136 | A1 | | 4/2002 | Ladish et al. |

FOREIGN PATENT DOCUMENTS

| | | |
|---|---|---|
| DE | 4208715 | 9/1992 |
| DE | 92 07 847.8 | 10/1992 |
| DE | 19526543 | 1/1996 |
| EP | 0612587 | 8/1994 |
| EP | 0623426 | 11/1994 |
| EP | 0873221 | 10/1998 |
| EP | 0778108 | 11/1999 |
| FR | 2 325 469 | 4/1977 |
| GB | 2 107 627 | 5/1983 |
| GB | 2 291 612 | 1/1996 |
| GB | 2367779 | 4/2002 |
| JP | 03049879 | 3/1991 |
| JP | 03166064 | 7/1991 |
| JP | 06114751 | 4/1994 |
| JP | 06182672 | 7/1994 |
| JP | 7-256564 | 9/1995 |
| JP | 08216043 | 8/1996 |
| WO | WO 093/06320 | 4/1993 |
| WO | WO 95/29794 | 11/1995 |
| WO | WO 97/24205 | 7/1997 |
| WO | 9955494 | 11/1999 |

* cited by examiner

FASTENER FEEDING SYSTEM

RELATED APPLICATIONS

The present application claims the benefit of prior-filed, co-pending provisional patent application Ser. No. 60/431,917, filed Dec. 9, 2002 and prior-filed, provisional patent application Ser. No. 60/492,426, filed Aug. 4, 2003.

FIELD OF THE INVENTION

The invention relates to fastener feeding systems and, more particularly, to systems for feeding collated fasteners.

BACKGROUND OF THE INVENTION

Fastener feeding devices have been developed that do not require the operator to hold the fastener in place before driving the fastener into the workpiece. These "automatic" fastener driving devices are typically configured for use with a strip that carries a set of collated fasteners. The collated fastener strips are automatically advanced through the fastener feeding device as individual fasteners are removed from the strip and driven into the workpiece. As the strip is advanced through the fastener driving device, individual fasteners are sequentially positioned for engagement with the drill bit and aligned for driving into the workpiece. Once a fastener is driven into the workpiece, the fastener feeding device advances the strip such that the next fastener is positioned for driving into the workpiece.

SUMMARY OF THE INVENTION

In some aspects, the present invention may provide a fastener feeding device including a housing that is securable to a power tool, a glider assembly that is slidably coupled to the housing, a depth control nose slidably coupled to the glider assembly, and a locking member pivotally coupled to the glider. The locking member may be pivotally movable to engage the depth control nose and to substantially fix a relative position between the depth control nose and the glider assembly.

Also, in some aspects, the present invention may provide a fastener feeding device including a mounting sleeve coupleable to a power tool, a depth stop coupled to the mounting sleeve for sliding movement along an axis, and a depth stop adjusting ring. The depth stop adjusting ring may at least partially surround the mounting sleeve and may operatively engage the depth stop such that rotational movement of the depth stop adjusting ring moves the depth stop axially with respect to the mounting sleeve to adjust a depth to which a fastener driven by the system is driven relative to a surface of a workpiece (e.g. flush, sub-flush or proud).

In addition, in some aspects, the present invention may provide a fastener feeding device that is supportable on a support projection of a power tool. The support projection may define a tool axis and a circumferential groove. The device may include a mounting sleeve having an outer surface, an inner surface, and at least one aperture extending between the outer surface and the inner surface. The device may also include a locking collar at least partially surrounding the mounting sleeve and including an inner surface that provides at least one cam surface facing the outer surface of the mounting sleeve. At least one clamping block may be received by the aperture and may engage the cam surface such that rotation of the locking collar about the tool axis urges the clamping block radially inwardly through the aperture and into engagement with the circumferential groove, which may secure the device to the power tool.

Further, in some aspects, the present invention may provide a locking assembly for securing a device to a power tool. The power tool may include a support projection that defines a tool axis, and the locking assembly may include a mounting sleeve defining a cavity that receives the support projection. The mounting sleeve may also define at least one aperture that communicates with the cavity and receives a clamping block that is selectively engageable with the support projection to secure the device to the power tool. A locking collar may at least partially surround the mounting sleeve and may be rotatable about the tool axis to a locked position, in which the locking collar may urge the clamping blocks into engagement with the support projection, and an unlocked position, in which the locking collar releases the clamping blocks, thereby allowing the clamping blocks to be moved out of engagement with the support projection.

Also, in some aspects, the present invention may provide a fastener driving device including a strip tensioner assembly for selective and variable frictional engagement with a strip of collated fasteners. The strip tensioner assembly may include a strip tensioner wheel rotatably supported by the device, a tensioner plate that is movable in response to rotation of the tensioner wheel. The tensioner wheel may include at least one cam surface that engages a projection on the tensioner plate. Engagement of the cam surface and the projection may move the spring plate toward or away from the strip of fasteners in response to rotation of the tensioner wheel to adjust the relative amount of frictional engagement between the spring plate and the strip.

Independent features and independent advantages will become apparent to those skilled in the art upon review of the following detailed description, claims and drawings.

BRIEF DESCRIPTION OF THE DRAWINGS

FIG. 12 is an exploded perspective view of an alternative construction of a fastener feeding device.

FIG. 27 is a rear end view of the fastener feeding device of FIG. 13.

FIG. 39 is a top view of the fastener feeding device of FIG. 29.

Figures 1, 5, 6, 7, 8, 9:
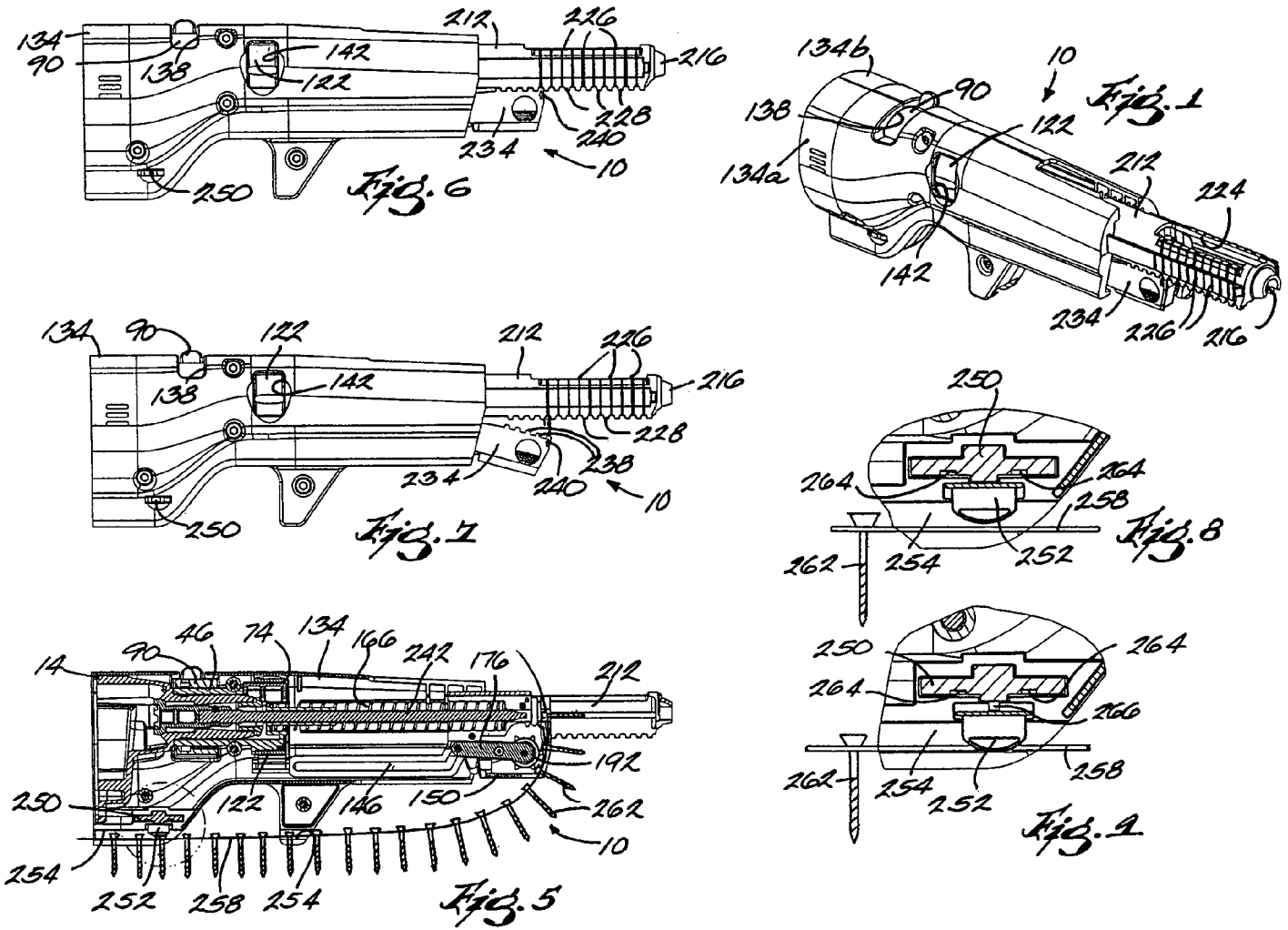
FIG. 1 is a perspective view of a fastener feeding device.
FIG. 5 is a section view taken generally along line 5—5 of FIG. 1.
FIG. 6 is a side view of the fastener feeding device of FIG. 1 in a first configuration.
FIG. 7 is a side view of the fastener feeding device of FIG. 1 in a second configuration.
FIGS. 8 and 9 are enlarged views of the portion of the fastener feeding device encircled in FIG. 5.

Before at least one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION

Figure 2:
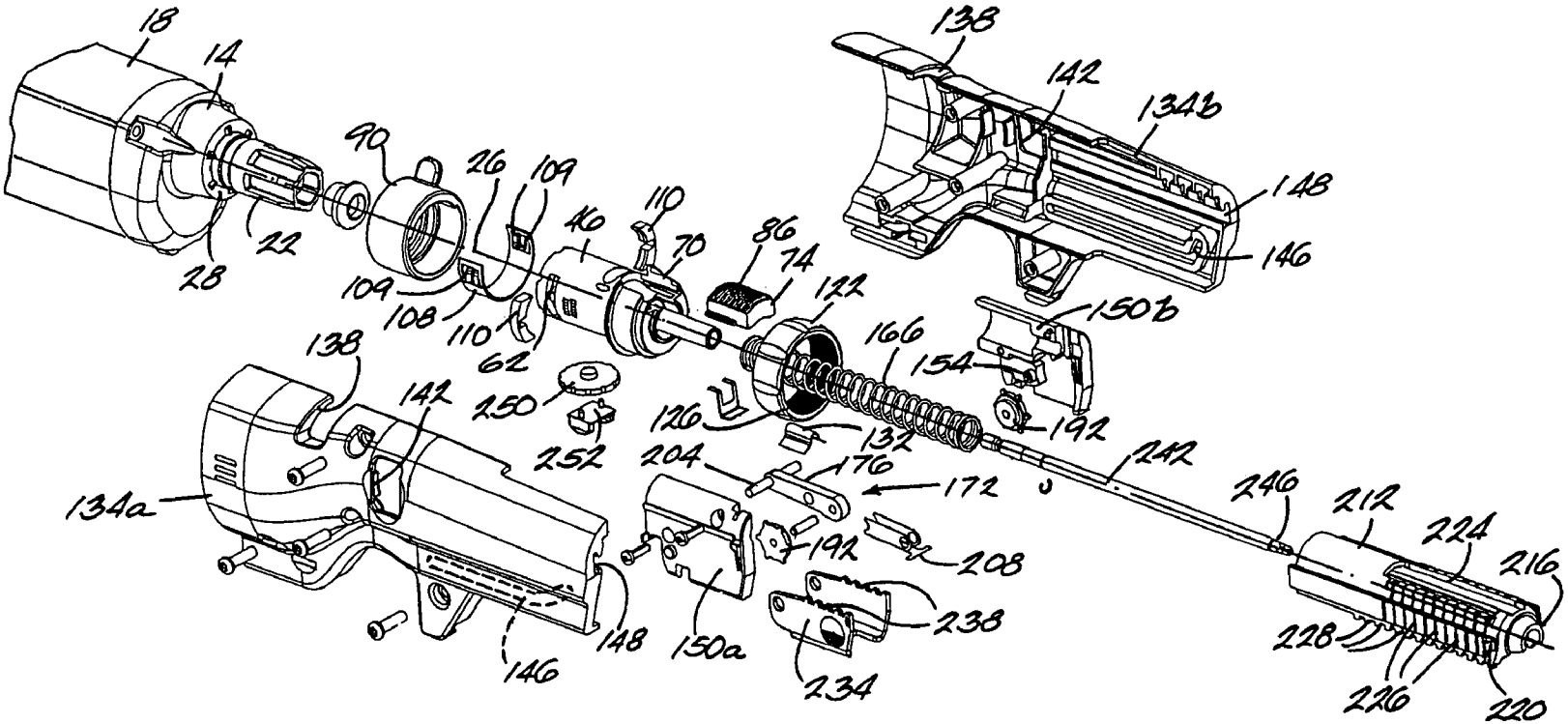
FIG. 2 is an exploded perspective view of the fastener feeding device of FIG. 1.
Figure 3:
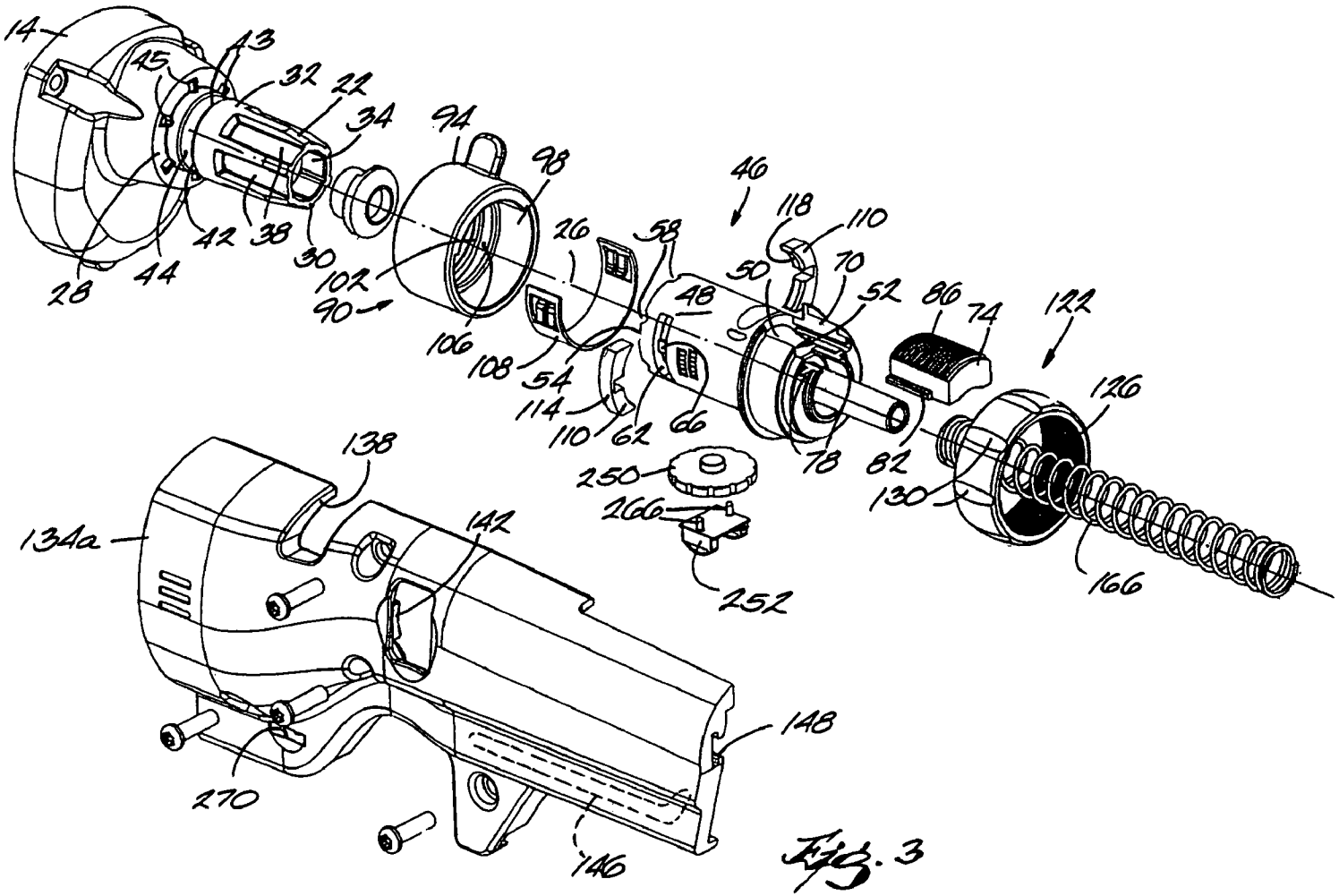
FIG. 3 is an enlarged view of a portion of the fastener feeding device of FIG. 1.

The figures illustrate a fastener feeding device 10 embodying independent aspects of the invention. As shown in FIGS. 1–3, in the illustrated construction and in some aspects, the device 10 is attachable to a nosepiece 14 of a rotary power tool 18, such as, for example, an electric or pneumatic drill, screwdriver, etc. The nosepiece 14 includes a generally cylindrical support projection 22 that defines a tool axis 26 and that extends from an abutting surface 28 defined by the nosepiece 14. The abutting surface 28 is substantially normal to the tool axis 26.

The support projection 22 includes a distal end 30 that is spaced from the power tool 18, an outer surface 32, and an inner surface 34. A plurality of angularly spaced apart and axially extending grooves 38 are recessed from the outer surface 32 and extend from the distal end 30 toward the power tool 18 but, in the illustrated construction, do not extend all the way to the abutting surface 28. A circumferential groove 42 is recessed from the outer surface 32 and is positioned between the abutting surface 28 and the axially extending grooves 38. The groove 42 includes filleted and/or chamfered edges 43 that extend between the outer surface 32 of the support projection 22 and a recessed surface 44 of the groove 42. The nosepiece 14 also includes a plurality of angularly spaced apart and axially extending cam projections 45 that are raised with respect to the abutting surface 28.

The device 10 includes a mounting sleeve 46 supportable on the support projection 22 of the nosepiece 14. The sleeve 46 is generally cylindrical and includes an outer surface 48 and an inner surface 50 that defines a cavity 52. The cavity 52 receives the support projection 22 when the device 10 is attached to the tool 18. An end surface 54 of the mounting sleeve 46 is engageable with the abutting surface 28 and defines a plurality of angularly spaced apart recesses 58 that receive the cam projections 45. The recesses 58 and cam projections 45 are configured to facilitate removal of the device 10 from the tool 18. Specifically, in some constructions, the mounting sleeve 46 can be rotated about the tool axis 26 such that the cam projections 45 engage the recesses 58 and urge the mounting sleeve 46 and the device 10 axially away from tool 18. The configuration and operation of the cam projections 45 and the recesses 58 is described in commonly assigned U.S. patent application Ser. No. 09/925,050, filed Aug. 8, 2001, now U.S. Pat. No. 6,499,381, issued Dec. 31, 2002, which is hereby incorporated by reference.

In other constructions (not shown), the projections and recesses can be configured differently such that removal of the device 10 from the tool 18 is accomplished by urging the device 10 axially away from the tool 18. Such an alternative configuration of projections and recesses is described in commonly assigned U.S. Pat. No. 5,341,704, issued Aug. 30, 1994, which is hereby incorporated by reference.

A pair of diametrically opposed, circumferentially extending apertures or slots 62 extend between the outer surface 48 and the inner surface 50 of the sleeve 46 and communicate with the cavity 52. A cross bar 66 extends axially across each slot 62 adjacent the inner surface 50. The slots 62 are axially spaced from the end surface 54 a distance that is substantially equal to the distance between the abutting surface 28 and the circumferential groove on the support projection 22, for reasons that will be discussed further below.

Opposite the end surface 54, the mounting sleeve 46 also includes an axially extending cutout 70 that communicates with the cavity 52 and that receives a depth stop 74. The depth stop 74 is axially adjustable with respect to the mounting sleeve 46 to determine a driven depth of a fastener driven by the device. The cutout 70 includes a pair of axially extending grooves 78 that receive corresponding guide ribs 82 defined by the depth stop 74 and guide the depth stop 74 for axial movement with respect to the mounting sleeve 46. The depth stop 74 also includes an externally threaded portion 86 that facilitates fine axial adjustment of the depth stop 74, as discussed further below.

The device 10 also includes a locking collar 90 that generally surrounds the mounting sleeve 46 and that is rotatable about the tool axis 26 to selectively secure the device 10 to the nosepiece 14. The collar 90 is generally annular and includes an outer surface 94 and an inner surface 98. A pair of circumferentially extending grooves 102 are recessed from the inner surface 98 and define radially inwardly facing cam surfaces 106. In the illustrated construction, the cam surfaces 106 each extend circumferentially about half-way around the inner surface 98, and generally converge toward the tool axis 26. A detent collar 108 including spring fingers 109 is supported between the locking collar 90 and the mounting sleeve 46. In the illustrated construction, the detent collar 108 provides detent engagement of the locking collar 90 with respect to the mounting sleeve 46 in the locked position, in which the device 10 is locked to the nosepiece 14. In other constructions (not shown), the detent engagement may be provided in another rotational position, such as, for example, the unlocked position, in which the device 10 is removable from the nosepiece 14, or in other rotational positions.

Each groove 102 is adapted to receive a clamping block 110. The clamping blocks 110 have an arcuate profile and each includes a convex camming surface 114 and a concave clamping surface 118. The camming surface 114 mates with the cam surface 106 of the corresponding circumferential groove 102, and the clamping surface 118 is selectively engageable with the recessed surface 44 of the support projection 22 to secure the device 10 to the nosepiece 14.

Figure 4:
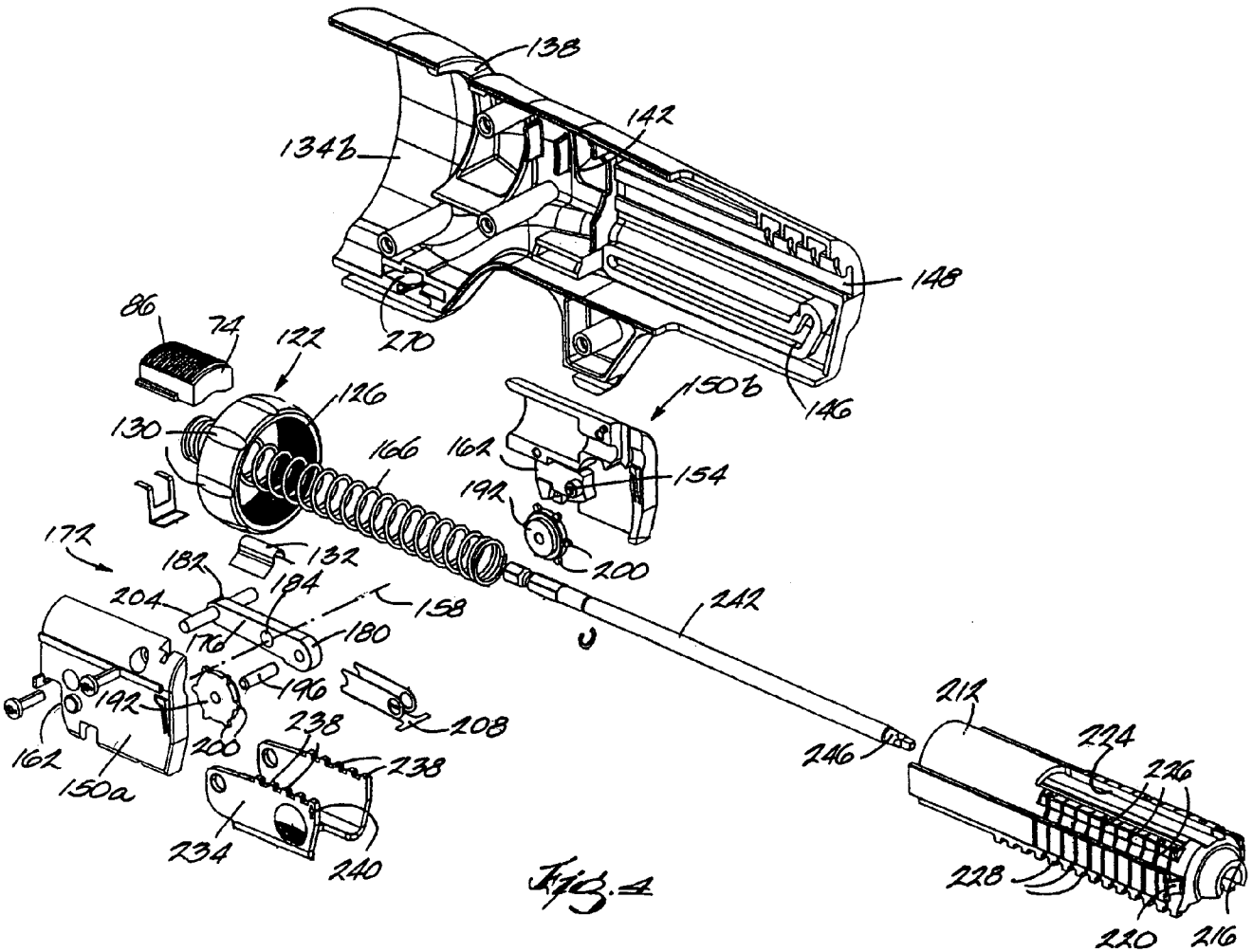
FIG. 4 is an enlarged view of a portion of the fastener feeding device of FIG. 1.

Referring also to FIGS. 4 and 5, the device 10 further includes a depth stop adjusting ring 122. The depth stop adjusting ring 122 is generally annular and includes an inner surface defining internal threads 126 that threadably mate with the externally threaded portion 86 of the depth stop 74. The depth stop adjusting ring 122 generally surrounds the mounting sleeve 46 in the vicinity of the cutout 70 and is rotatable with respect to the mounting sleeve 46 to axially move the depth stop 74. Rotation of the depth stop adjusting ring 122 determines the driven depth of a fastener driven by the device 10 by changing the axial positioning of the depth stop 74, as will be discussed further below. The depth stop adjusting ring 122 includes a plurality of grooves 130 and/or ridges that enhance gripping of the adjusting ring 122. A detent spring 132 is engageable with the grooves 130 in the depth stop adjusting ring 122 to provide a detent arrangement for adjustment of the adjusting ring 122 between a plurality of predetermined rotational positions that correspond to predetermined axial positions of the depth stop 74.

In the illustrated construction, the mounting sleeve 46, the locking collar 90, the depth stop 74, and the depth stop adjusting ring 122 are all at least partially enclosed within a housing 134. The housing 134 includes a first portion **134*a* and a second portion 134*b*. The first and second portions 134*a*, 134*b* are securable to one another to surround and support various components of the device 10. The housing 134 defines a locking aperture 138 that allows operator access to the locking collar 90 to move the locking collar 90 between the locked and unlocked positions. The housing 134 also defines an adjusting aperture 142 that allows operator access to the depth stop adjusting ring 122**.

Each housing portion **134*a*, 134*b* includes an inner wall that defines a screw advancing slot 146 and an axially-extending T-shaped groove 148. In the illustrated construction, the screw advancing slots 146 angle upwardly at the forward end of the housing portions 134*a*, 134*b*. As will be discussed further below, this configuration advances a screw through the device 10 as the device 10 engages and is urged toward the workpiece. In alternate constructions (not shown), the screw advancing slots 146 can angle downwardly at the forward end of the housing portions 134*a*, 134*b*, thereby advancing the screw through the device 10 as the device 10** is withdrawn from and disengages the workpiece.

A glider assembly 150 is slidably supported by the housing 134 and includes a first portion **150*a* and a second portion 150*b*. Each portion of the glider assembly 150 includes a radially inwardly extending pivot pin 154. When the portions 150*a* and 150*b* are assembled, the pins 154 are substantially collinear and define a pivot axis 158. Each portion 150*a*, 150*b* also includes an arcuate guide surface 162 positioned rearwardly of and having a radius of curvature centered upon the pivot axis 158**.

The glider assembly 150 is slidable along the tool axis 26 and is forwardly biased by a spring 166. One end of the spring 166 is held substantially fixed with respect to the tool 18 and engages the mounting sleeve 46. The opposite end of the spring 166 engages the glider assembly 150. The glider assembly 150 is movable between a forwardly extended position and a retracted position.

A screw advancing assembly 172 is supported by and movable with the glider assembly 150. In the illustrated construction, the advancing assembly 172 includes a connecting arm 176 having a first end 180, a second end 182, and a central aperture 184 extending through the connecting arm 176 between the first and second ends 180, 182. The central aperture 184 receives the pivot pins 154 of the glider assembly 150, thereby pivotally coupling the connecting arm 176 to the glider assembly 150 for pivotal movement about the pivot axis 158.

An engaging element includes, in the illustrated construction, a pair of spaced-apart collation-advancing starwheels 192 coupled to the first end 180 of the connecting arm 176.

The starwheels 192 are rotatably coupled to the first end 180 by a dowel pin 196. Each starwheel 192 includes a plurality of angularly spaced apart projections 200 that engage the collated strip of screws (see FIG. 5) to advance screws through the device 10, as will be discussed further below.

A follower pin 204 is coupled to the second end 182 of the connecting arm 176 and is substantially parallel to the pivot axis 158. The follower pin 204 closely follows the arcuate guide surfaces 162 of the glider assembly 150 and is received by the advancing slots 146 in the housing portions 134*a*, 134*b*. Movement of the glider assembly 150 along the tool axis 26 therefore pivots the connecting arm 176 about the pivot axis 158 due to engagement of the follower pin 204 with the angled portions of the advancing slots 146. A cantilever spring 208 engages the starwheels 192 as the connecting arm 176 pivots. The cantilever spring 208 substantially prevents rotation of the starwheels 192 during advancement of the collated strip of fasteners. It should be appreciated that in other constructions (not shown), different devices and mechanisms that restrict the rotation of the starwheels 192 such as, for example, one-way bearings, ratchet assemblies, etc., can also be used.

A workpiece-engaging depth control nose 212 is coupled to and selectively slidably movable with respect to the glider assembly 150. The depth control nose 212 includes an annular end surface 216 that engages the workpiece during fastener driving operations. The depth control nose 212 also includes radially outwardly extending T-shaped guide ribs 220 that are slidably received by the T-shaped grooves 148 of the housing portions 134*a*, 134*b* for guiding the depth control nose 212 along the tool axis 26. An upper wall of the depth control nose 212 defines a viewing aperture 224 that allows an operator to view the fastener driving operation, and a plurality of adjustment graduation marks 226 are provided along the sides of the depth control nose 212. Thicker graduation marks 226 are provided at intervals such as 1 ", 2" and 3", while thinner marks 226 are provided at smaller intervals, such as every ¼".

A lower portion of the depth control nose 212 includes a plurality of notches or teeth 228. A depth control nose locking member 234 is pivotally coupled to the glider assembly 150 for pivotal movement about an axis that is substantially parallel to the pivot axis 158. The locking member 234 includes an upper surface having a plurality of notches or teeth 238 that are configured to mate or mesh with the teeth 228 in the depth control nose 212. The locking member 234 is pivotally movable between a latched position (see FIG. 6), in which the teeth 228, 238 are substantially inter-engaged to prevent relative sliding movement between the depth control nose 212 and the glider assembly 150, and an unlatched position (see FIG. 7), in which the teeth 228, 238 are disengaged and the depth control nose 212 is movable with respect to the glider assembly 150. The locking member 234 is spring biased and/or detently secured in the latched position.

The relative position of the depth control nose 212 with respect to the glider assembly 150 can be adjusted by pivoting the locking member 234 downwardly to the unlatched position and sliding the depth control nose 212 along the tool axis 26. In this regard, the device 10 can accommodate fasteners having a variety of lengths. For example, for a longer fastener, the depth control nose 212 would be moved to a forward position such that a distance between the annular end surface 216 and the starwheels 192 is only slightly larger than the length of the fastener. For a shorter fastener, the depth control nose 212 would be moved rearwardly to reduce the distance between the end surface 216 and the starwheels 192. Once an appropriate distance between the annular end surface 216 and the starwheels 192 is established, the locking member 234 is pivoted upwardly to the latched position to prevent further movement of the depth control nose 212 with respect to the gliding assembly 150. In the illustrated construction, the locking member 234 is provided with an arrow 240 with which the graduation marks 226 on the depth control nose 212 are generally alignable. For a given screw length, the depth control nose 212 is adjusted such that the arrow 240 is aligned with a graduation mark 226 having a value corresponding to the length of the screws to be driven.

A bit member 242 is coupled to and rotatably driven by the power tool 18. The bit member 242 extends along the tool axis 26 and through the mounting sleeve 46, the spring 166, the glider assembly 150, and the depth control nose 212. The bit member 242 is substantially axially fixed with respect to the tool 18 and has a length such that when the glider assembly 150 is in the extended position, a fastener engaging end 246 of the bit member 242 is positioned near the starwheels 192.

The device 10 also includes a strip tensioner assembly for adjusting the tension applied to the strip of screws. The strip tensioner assembly includes a strip tensioner wheel 250 and a tensioner spring plate 252. Referring to FIGS. 5, 8 and 9, a pair of slots 254 defined by the housing 134 receive a strip 258 carrying a plurality of collated screws 262. The strip 258 extends through the slots 254 and into and through the glider assembly 150. The tensioner wheel 250 is rotatably supported by the housing 134 and includes sloped cam surfaces 264. The spring plate 252 includes a pair of tabs 266 that are engageable with the cam surfaces 264 to move the spring plate 252 towards and away from the strip 258. Specifically, the spring plate 252 is movable between a widened position (see FIG. 8), in which the strip 258 is movable substantially unrestricted through the slot 254, and a narrowed position (see FIG. 9), in which the strip 258 is sandwiched between the slot 254 and the spring plate 252. Rotation of the tensioner wheel 250 moves the spring plate 252 toward or away from the strip 258 to adjust the relative amount of frictional resistance applied to the strip 258. An aperture 270 provided in each housing portion 134*a*, 134*b* provides operator access to the tensioner wheel 250 for rotation thereof. The tensioner wheel 250 and the spring plate 252 are provided to prevent unwanted and/or uncontrolled advancement of the strip 258 toward the glider assembly 150, and/or to prevent "sagging" of the strip 258 such as may be caused when operating the device 10 with relatively large screws 262.

Figure 11:
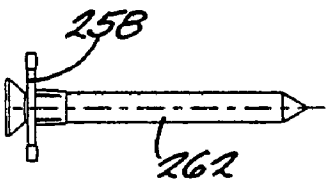
FIG. 11 is an end view of the collated screw strip of FIG. 10.
Figure 10:
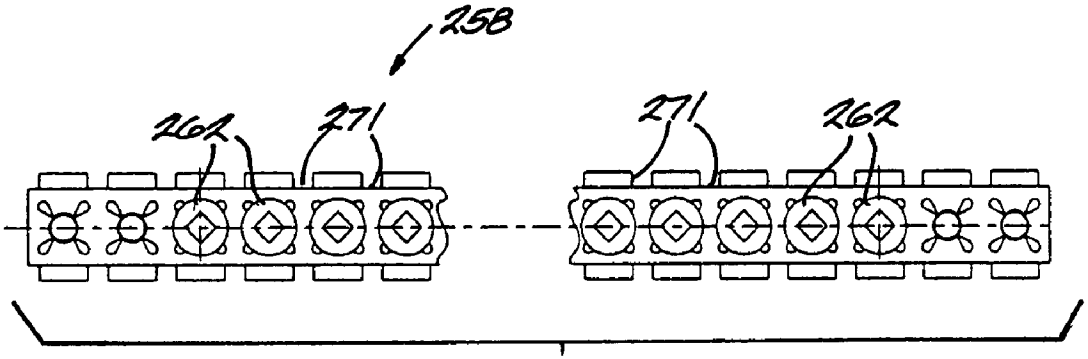
FIG. 10 is a top view of a collated screw strip configured for use with the fastener feeding device of FIG. 1.
Figure 11:
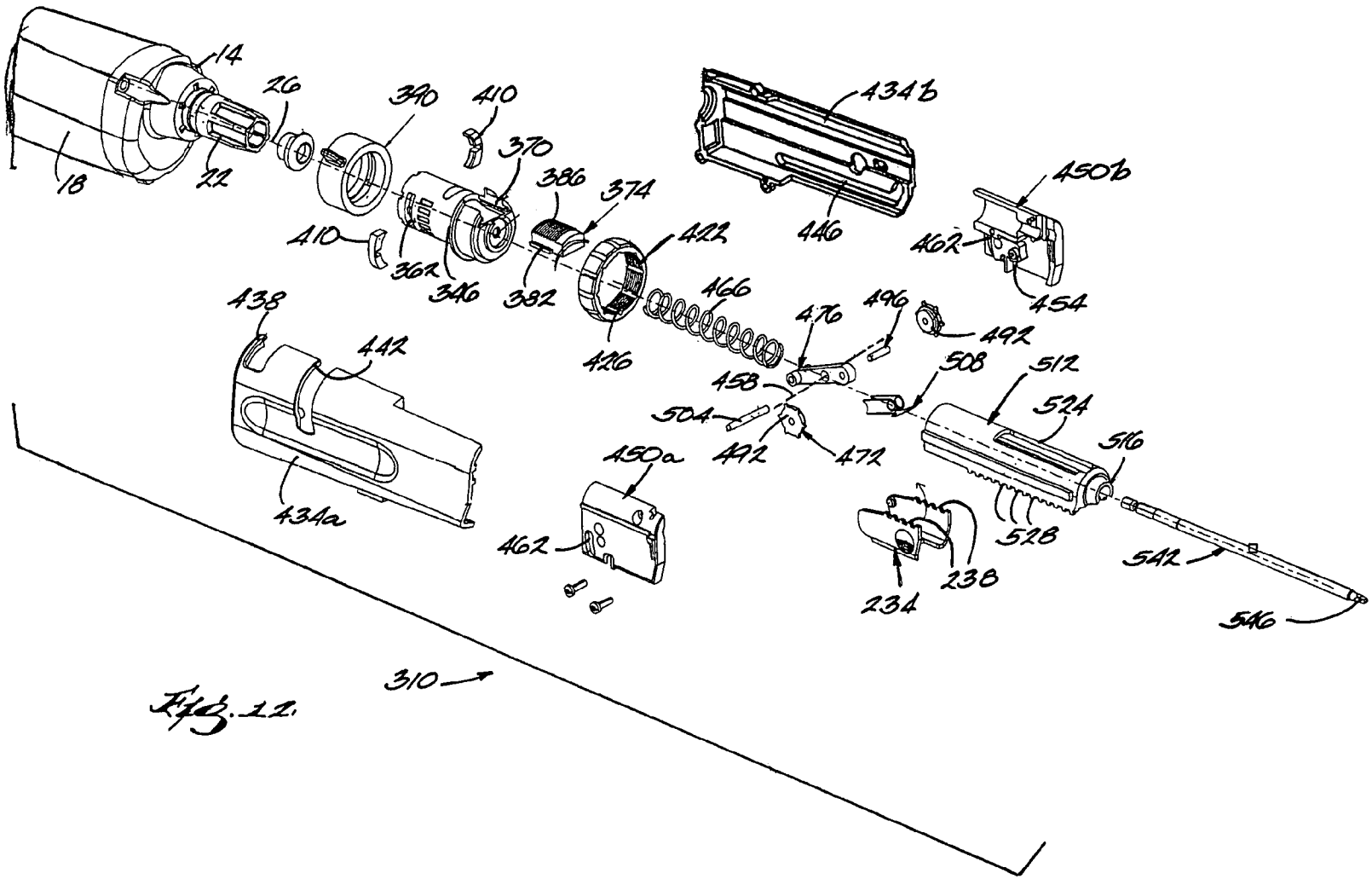
Figure 13:
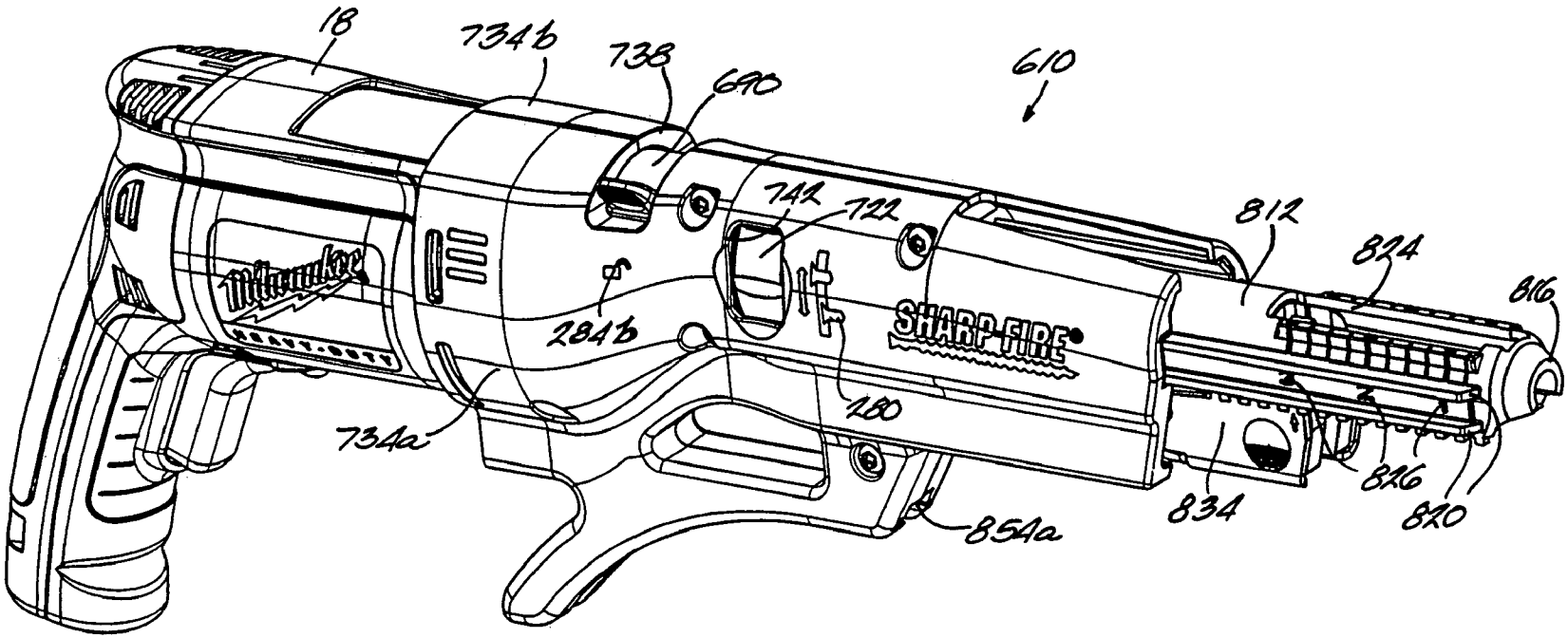
FIG. 13 is a perspective view of another alternative construction of a fastener feeding device coupled to a power tool.
Figure 14:
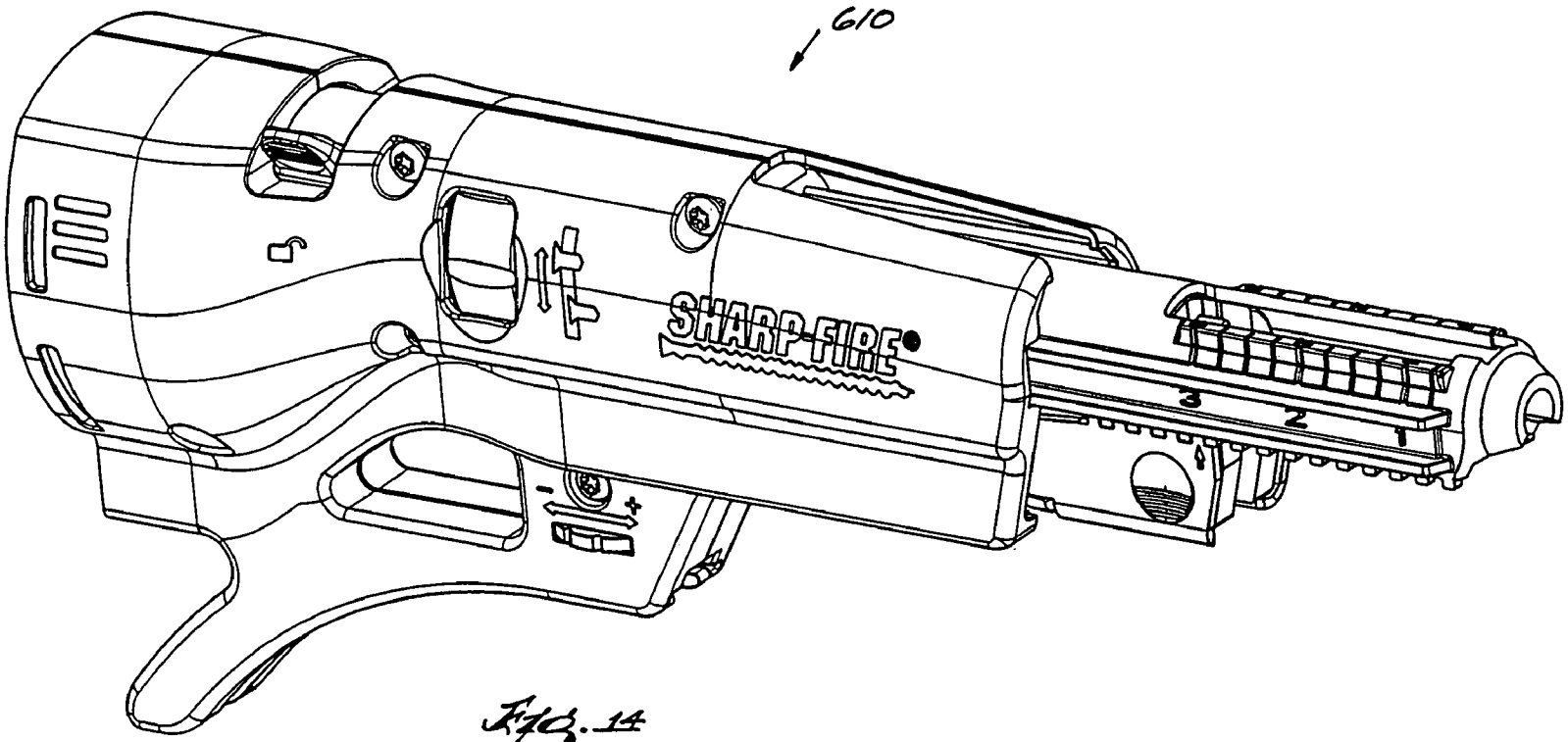
FIG. 14 is a view similar to FIG. 13 showing the device removed from the power tool.
Figure 15:
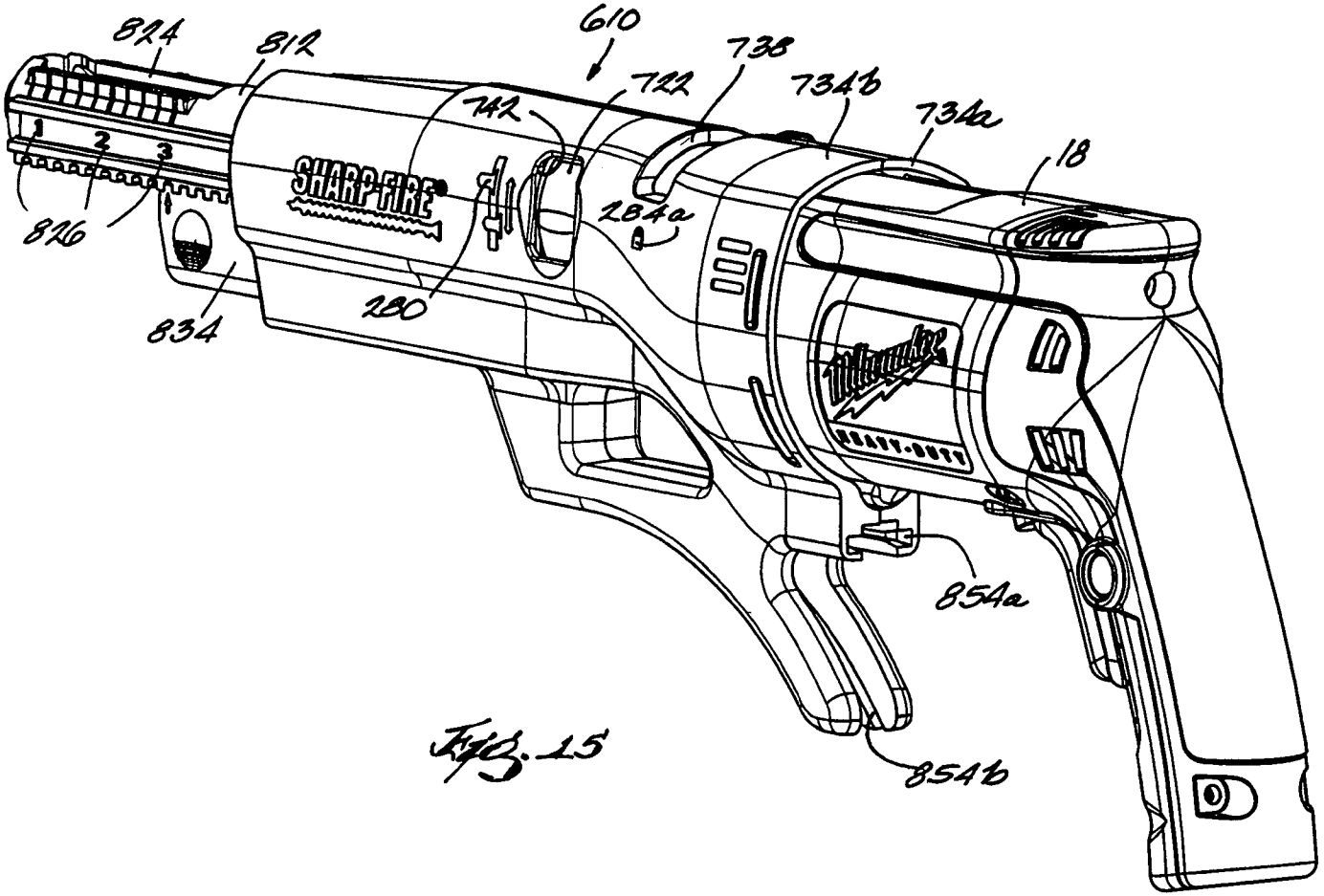
FIG. 15 is an alternate perspective view of the fastener feeding device of FIG. 13.
Figure 16:
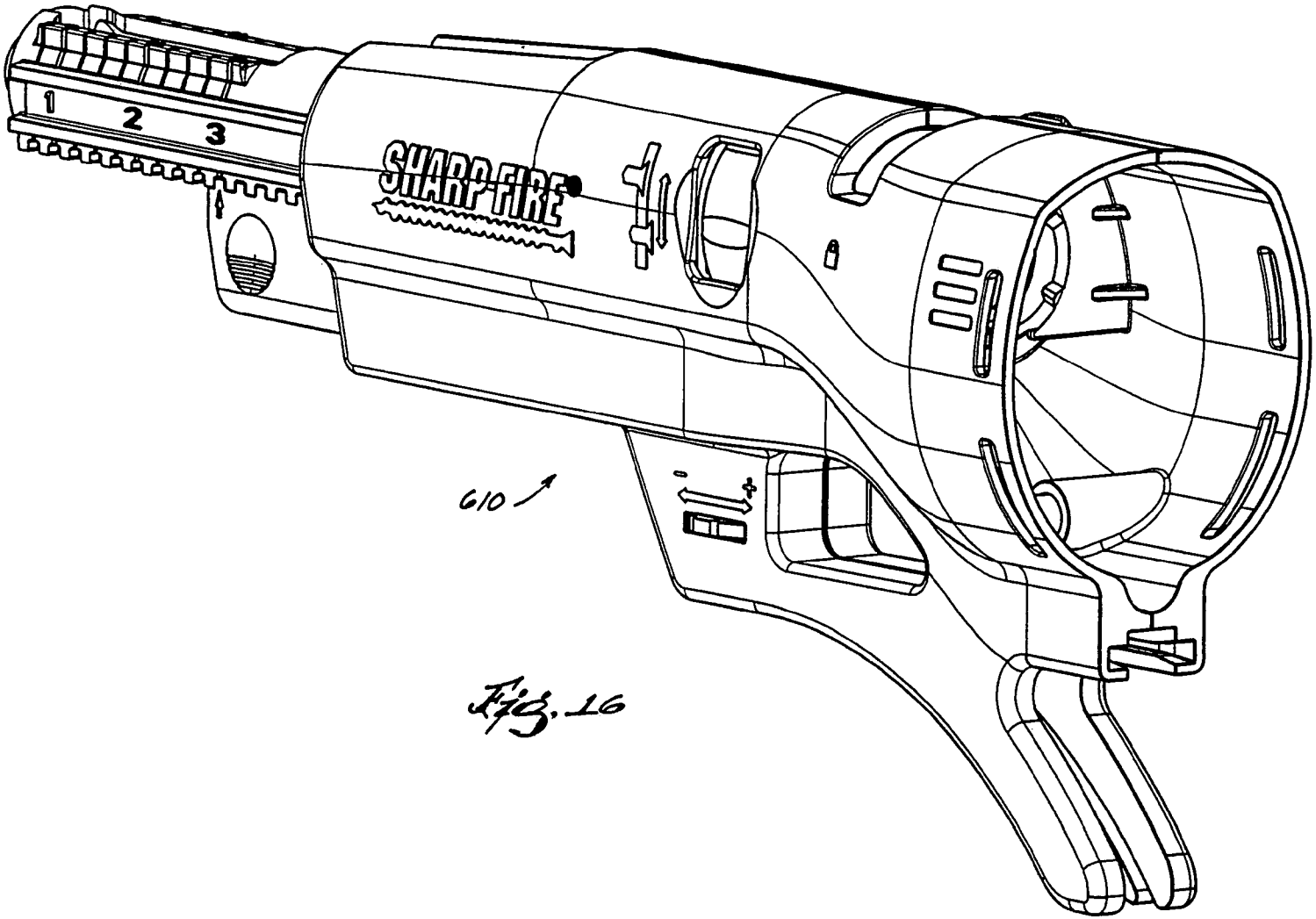
FIG. 16 is a view similar to FIG. 15 showing the device removed from the power tool.
Figure 17:
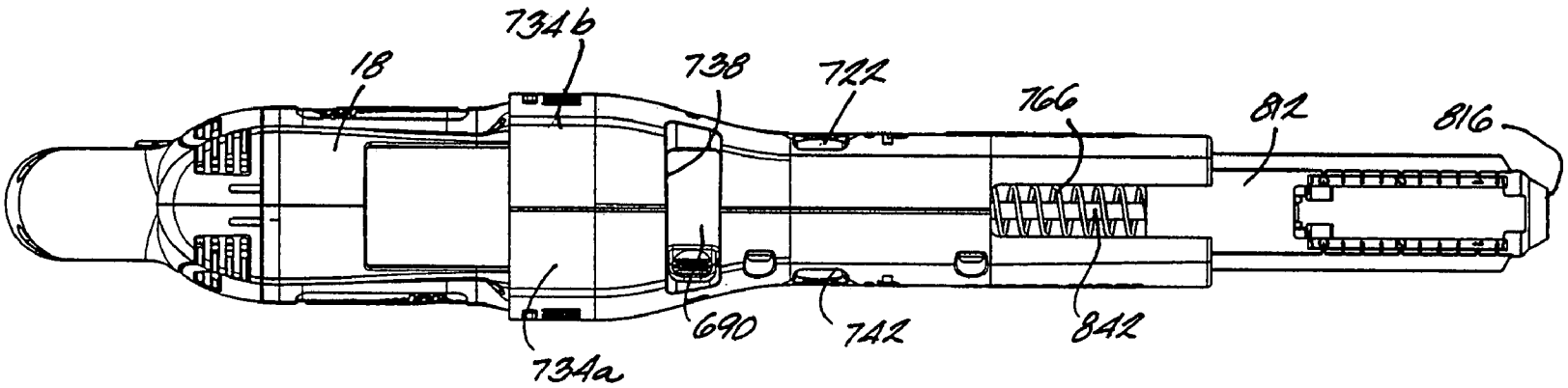
FIG. 17 is a top view of the fastener feeding device of FIG. 13.
Figure 18:
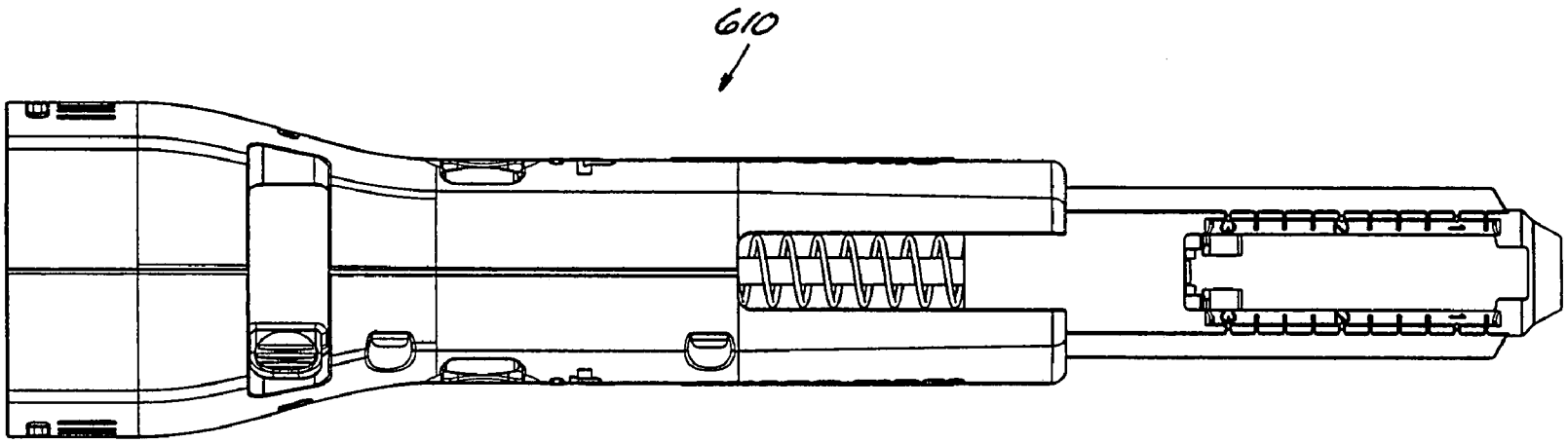
FIG. 18 is a view similar to FIG. 17 showing the device removed from the power tool.
Figure 19:
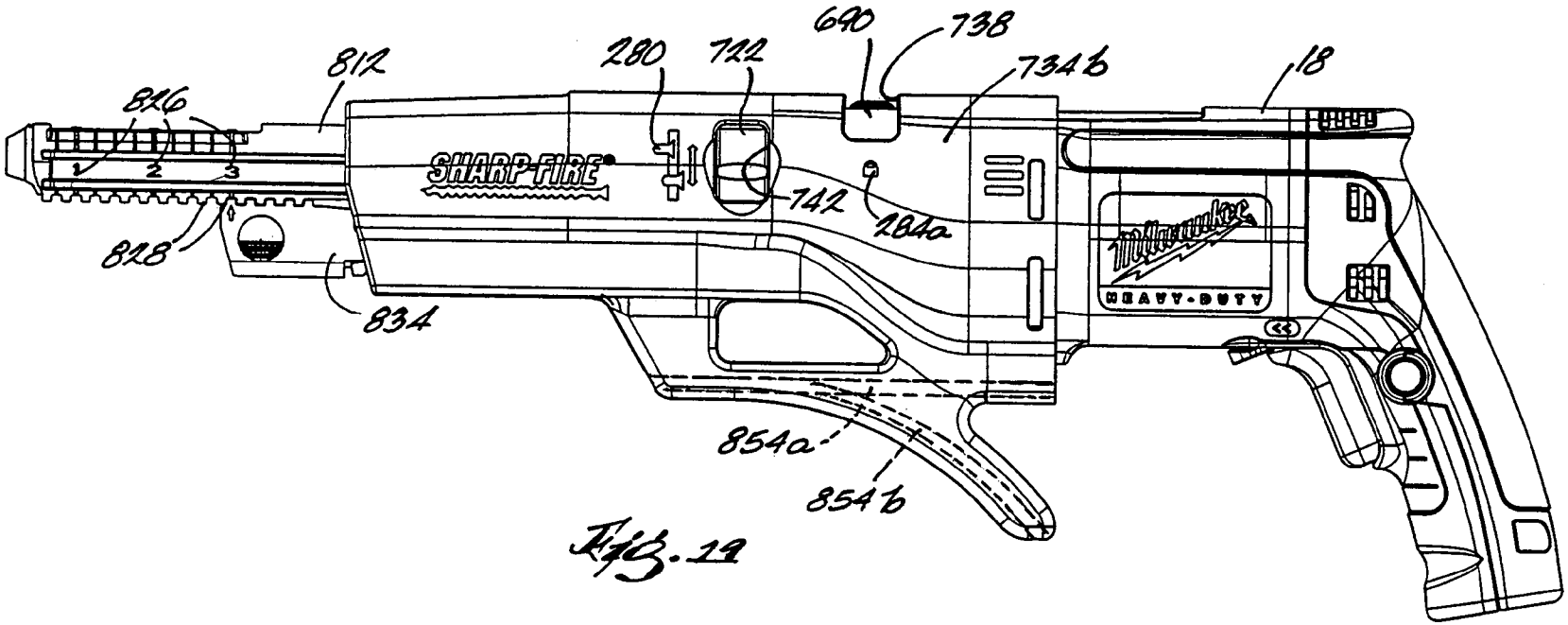
FIG. 19 is a left-side view of the fastener feeding device of FIG. 13.
Figure 20:
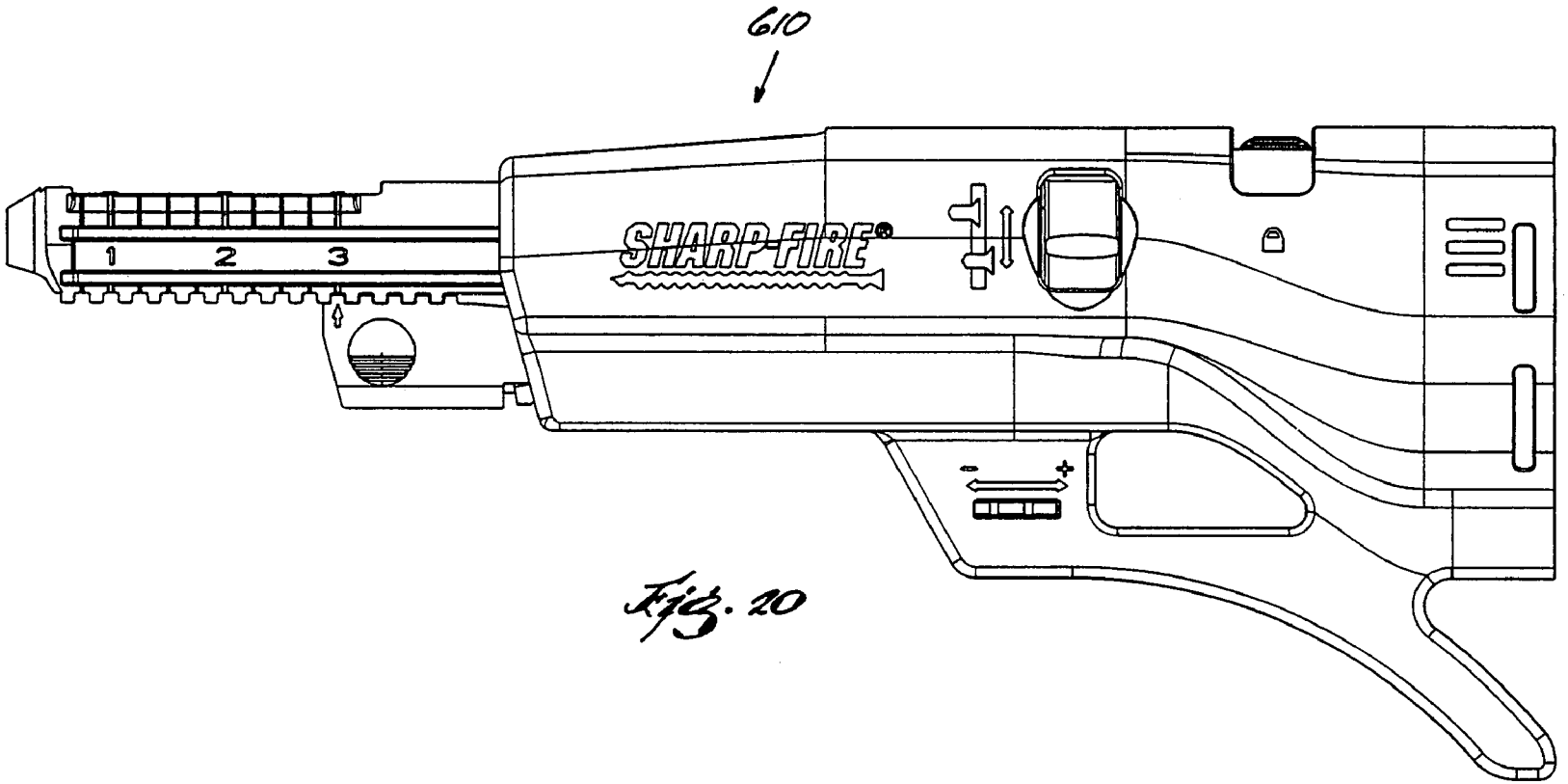
FIG. 20 is a view similar to FIG. 19 showing the device removed from the power tool.
Figure 21:
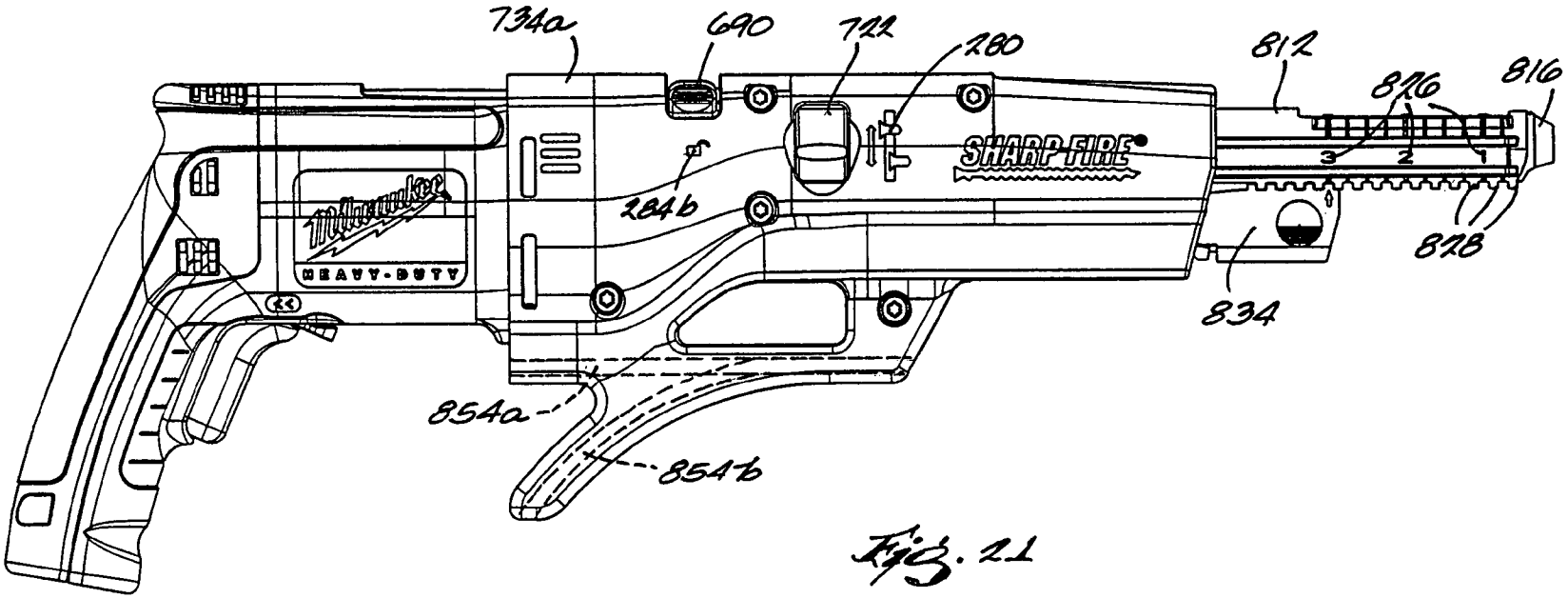
FIG. 21 is a right-side view of the fastener feeding device of FIG. 13.
Figure 22:
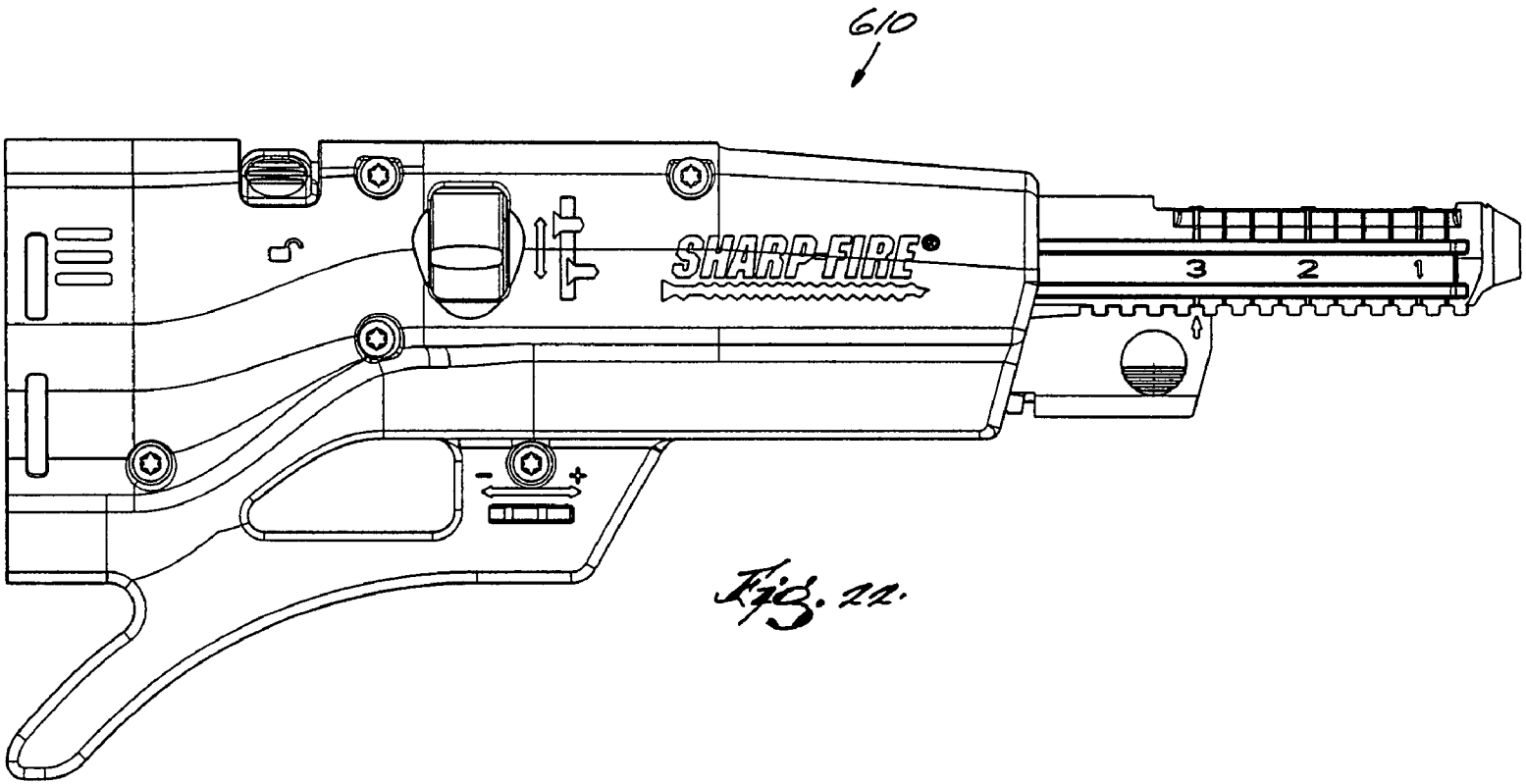
FIG. 22 is a view similar to FIG. 21 showing the device removed from the power tool.
Figure 23:
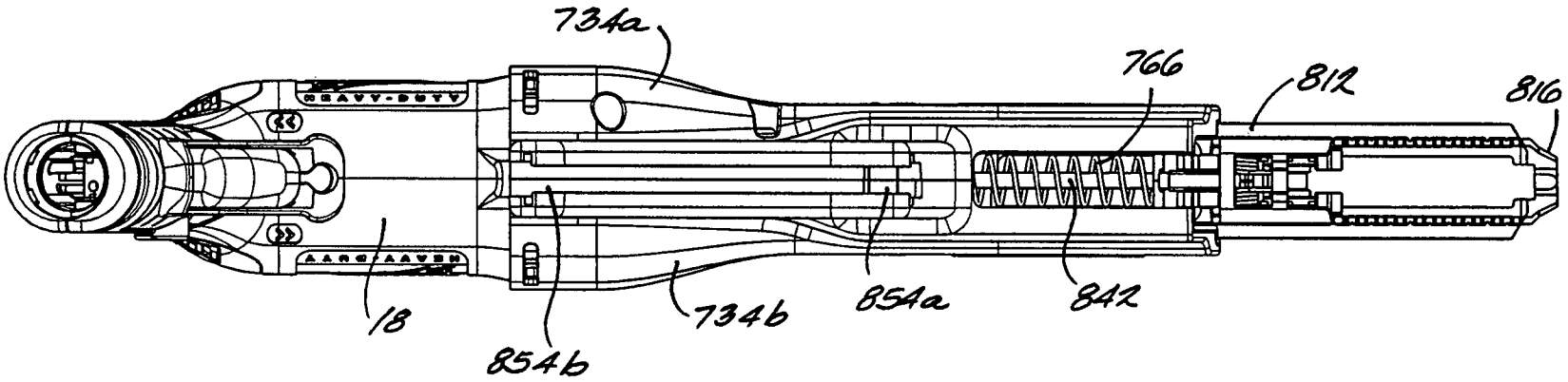
FIG. 23 is a bottom view of the fastener feeding device of FIG. 13.
Figure 24:
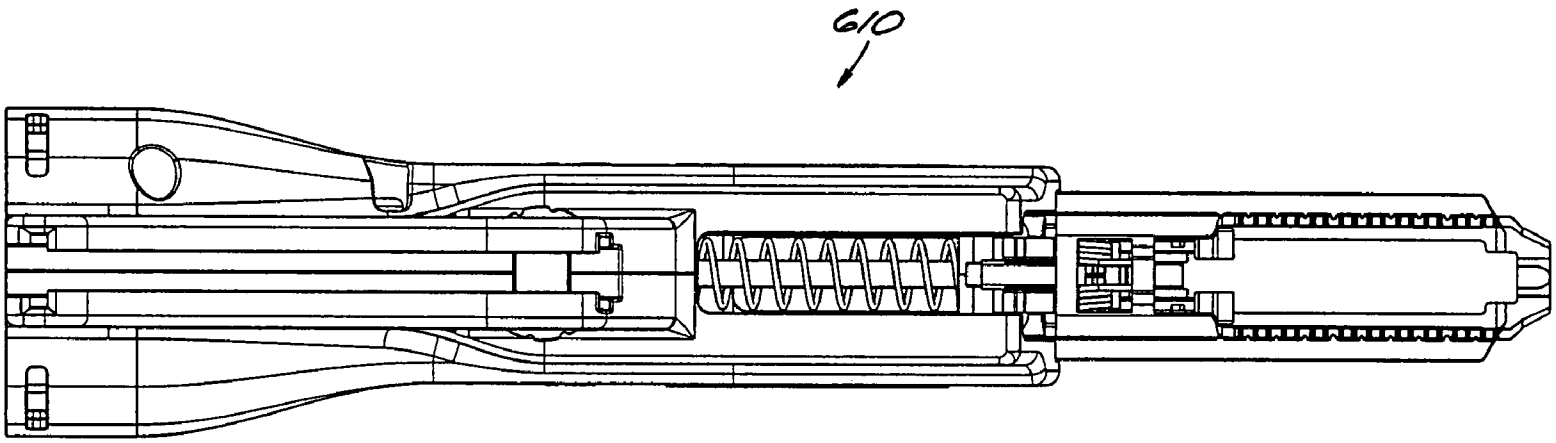
FIG. 24 is a view similar to FIG. 23 showing the device removed from the power tool.
Figure 25:
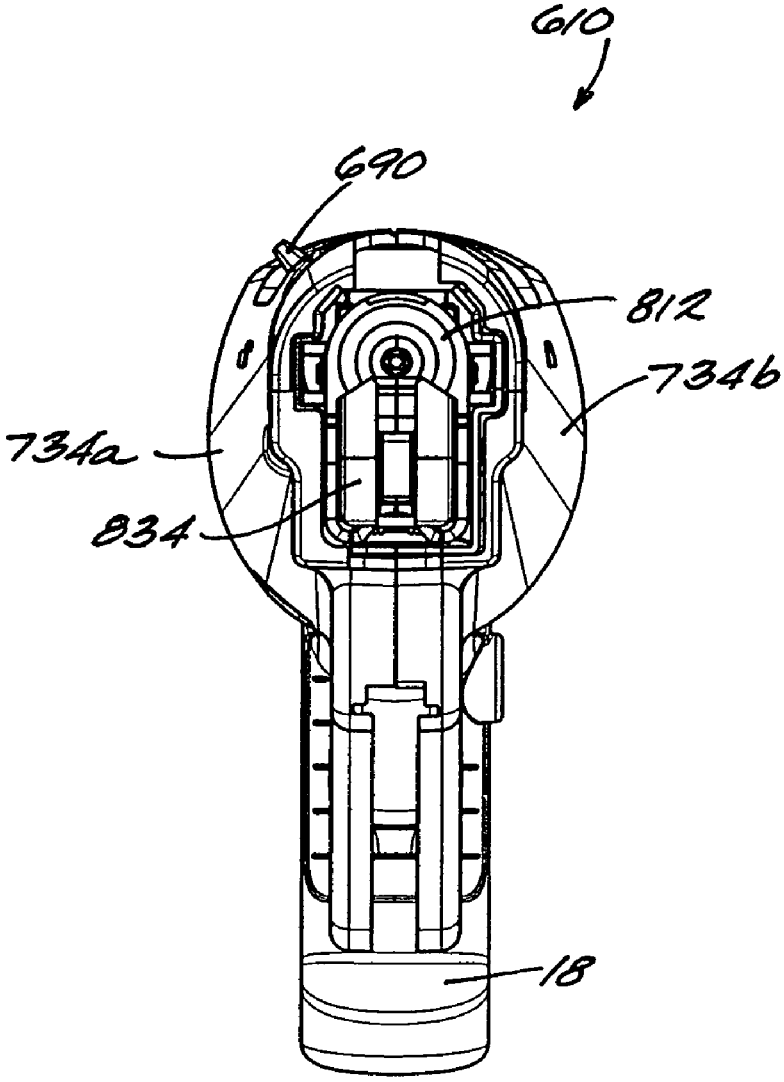
FIG. 25 is a front end view of the fastener feeding device of FIG. 13.
Figure 26:
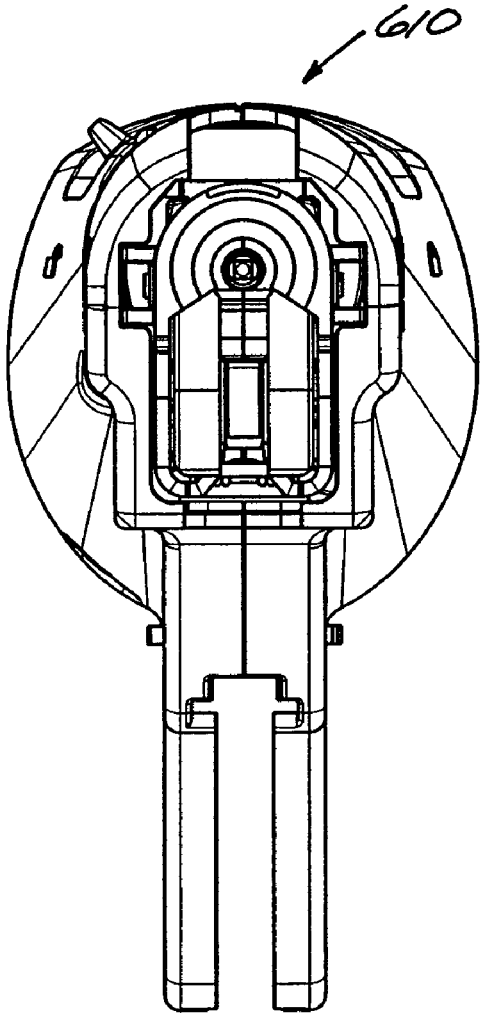
FIG. 26 is a view similar to FIG. 25 showing the device removed from the power tool.
Figure 21:
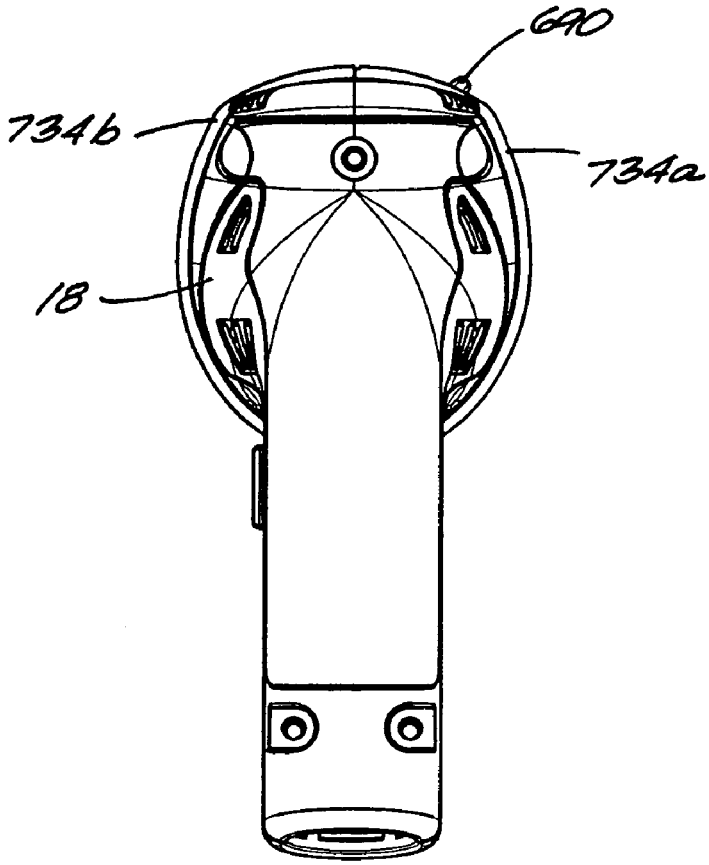
Figure 28:
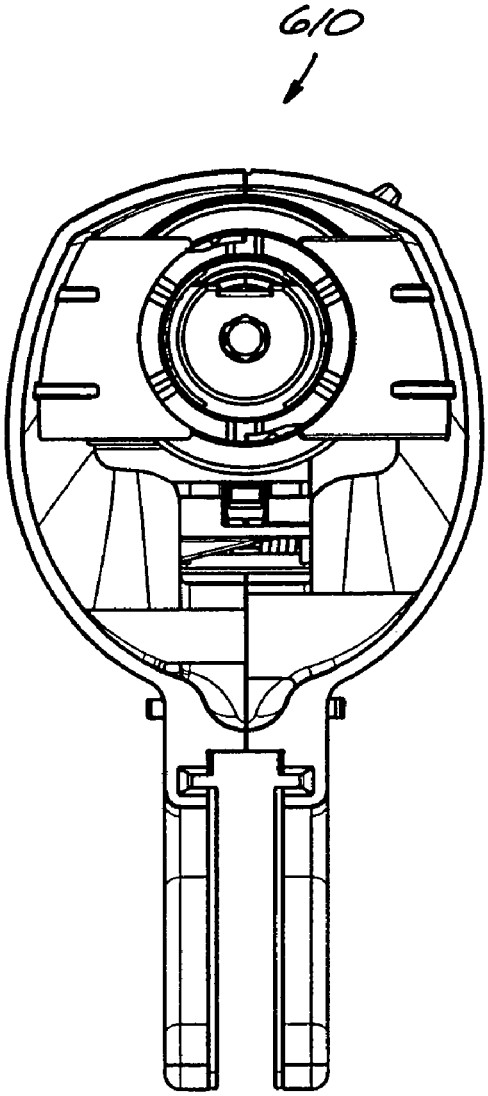
FIG. 28 is a view similar to FIG. 27 showing the device removed from the power tool.
Figure 29:
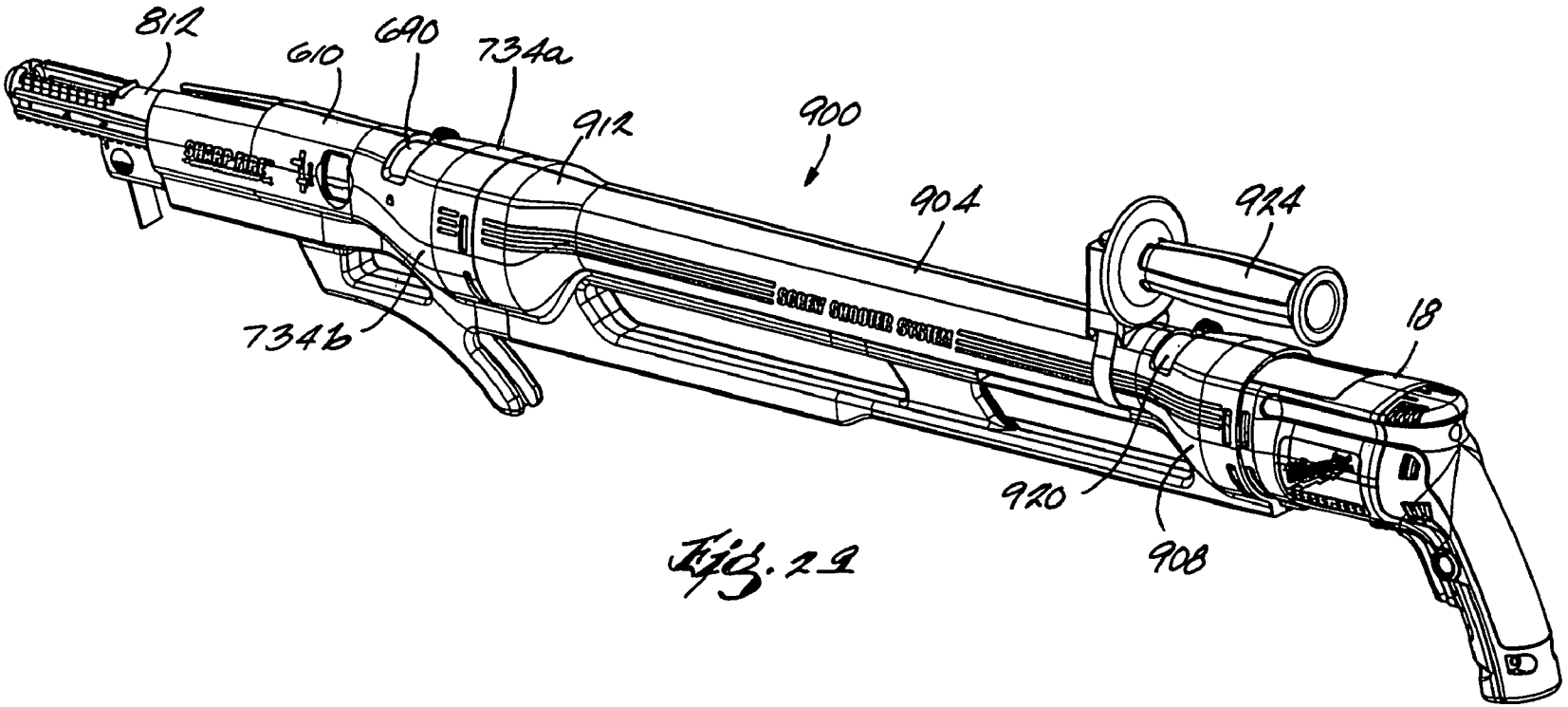
FIG. 29 is a perspective view of yet another alternative construction of a fastener feeding device.
Figure 30:
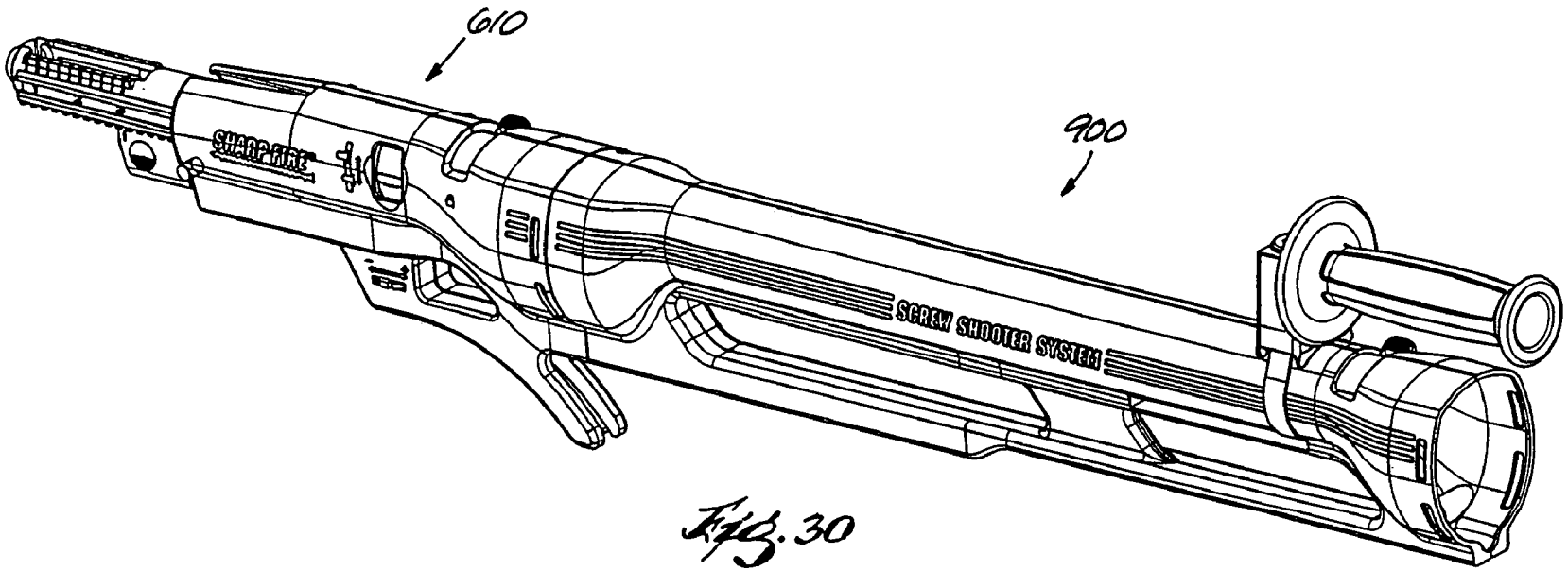
FIG. 30 is a view similar to FIG. 29 showing the device removed from the power tool.
Figure 31:
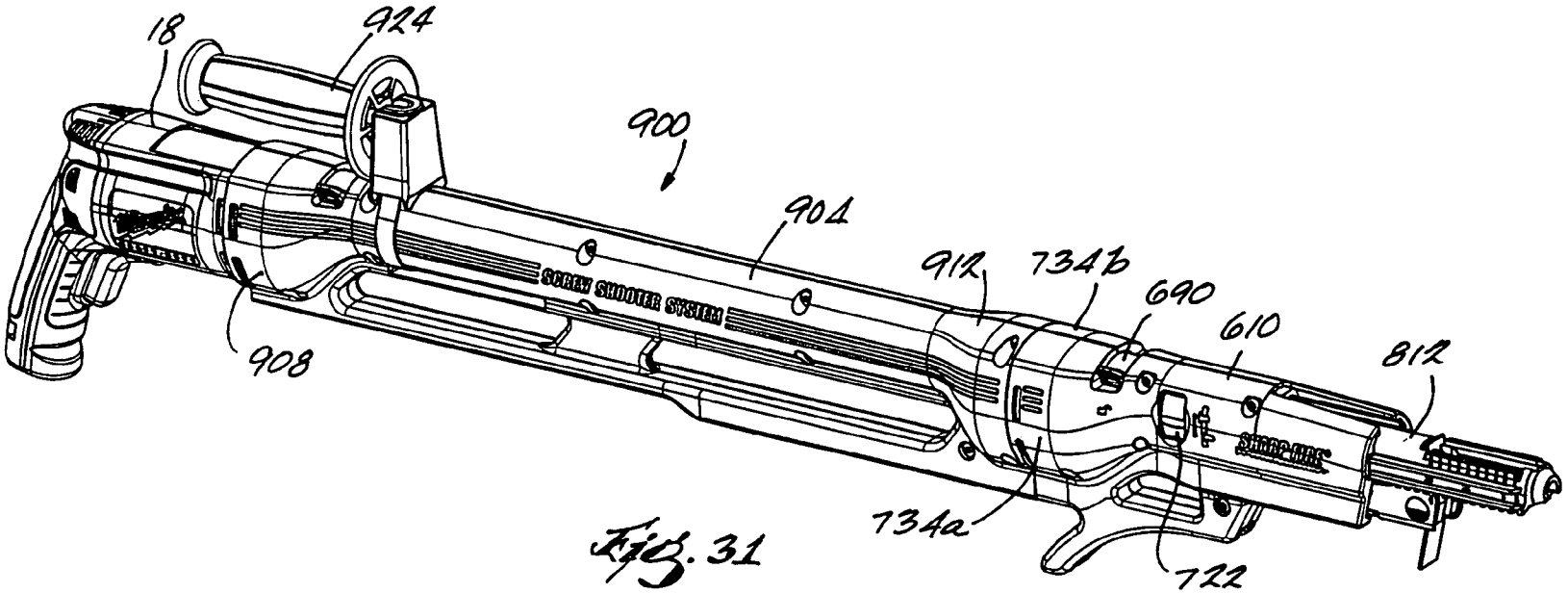
FIG. 31 is an alternate perspective view of the fastener feeding device of FIG. 29.
Figure 32:
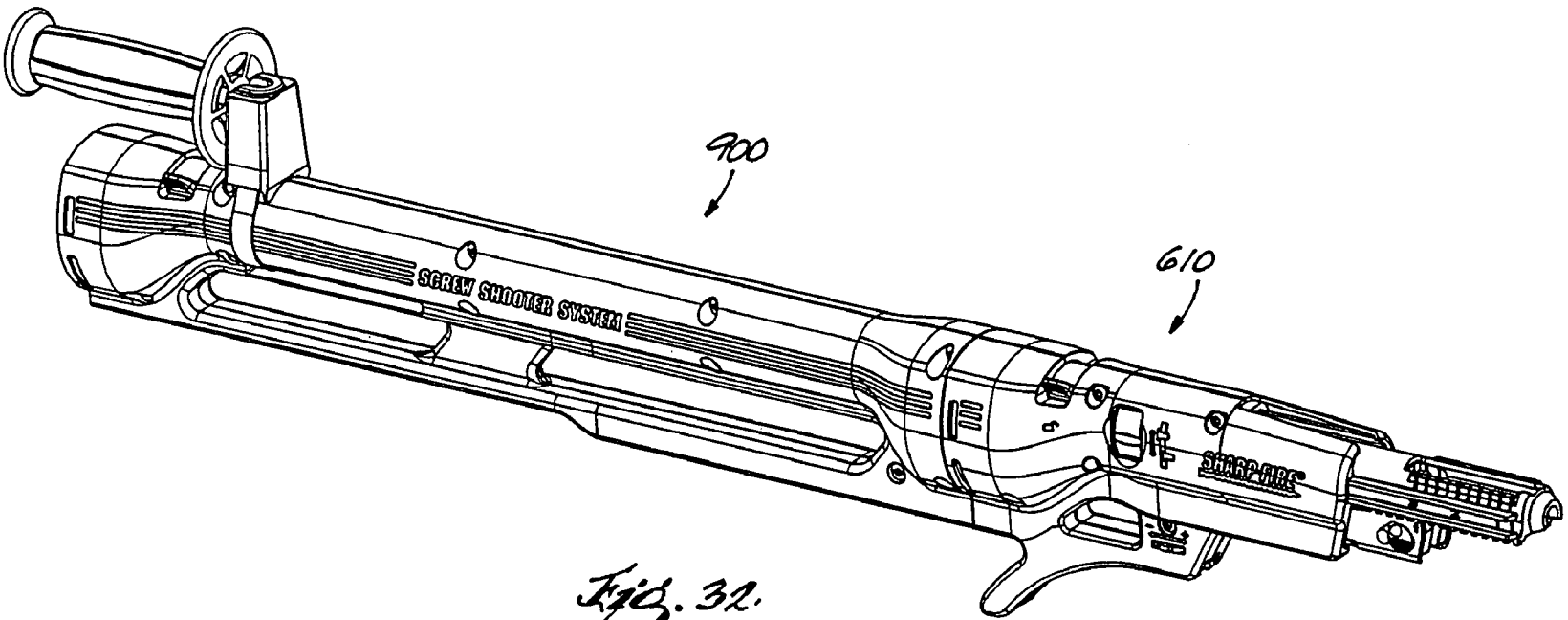
FIG. 32 is a view similar to FIG. 31 showing the device removed from the power tool.
Figure 33:
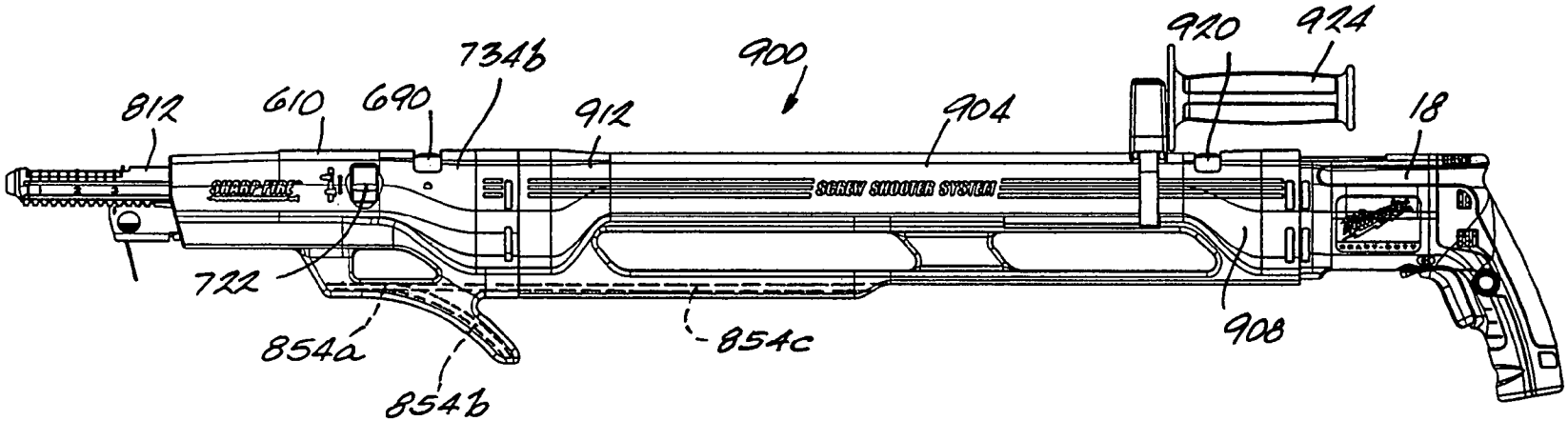
FIG. 33 is a left-side view of the fastener feeding device of FIG. 29.
Figure 34:
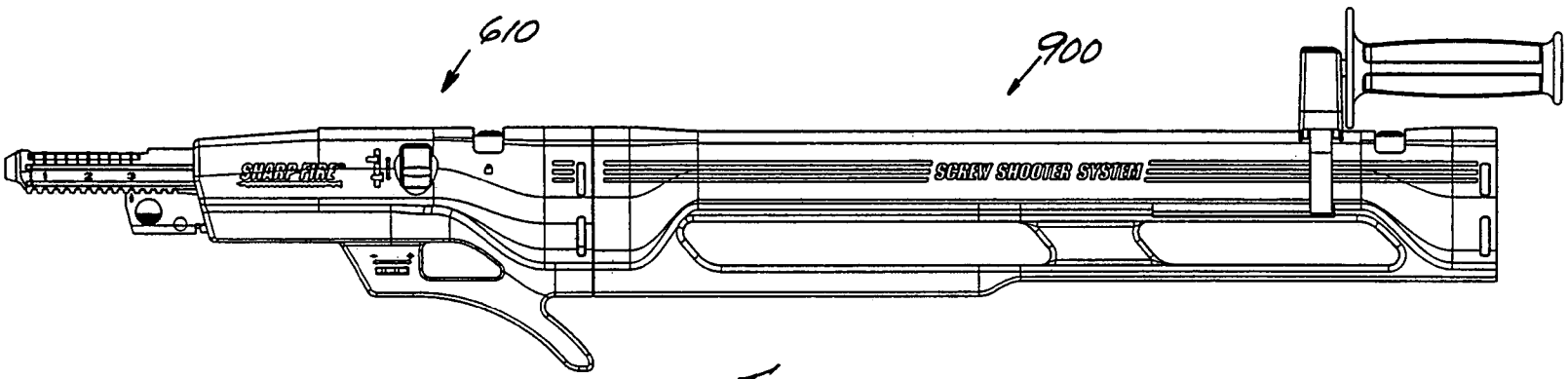
FIG. 34 is a view similar to FIG. 33 showing the device removed from the power tool.
Figure 35:
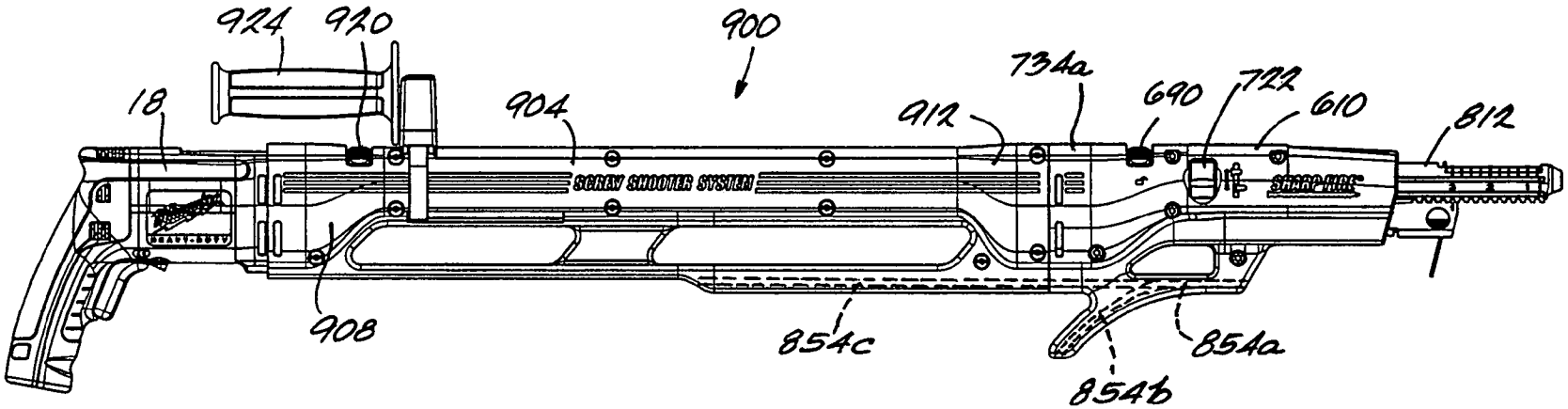
FIG. 35 is a right-side view of the fastener feeding device of FIG. 29.
Figure 36:
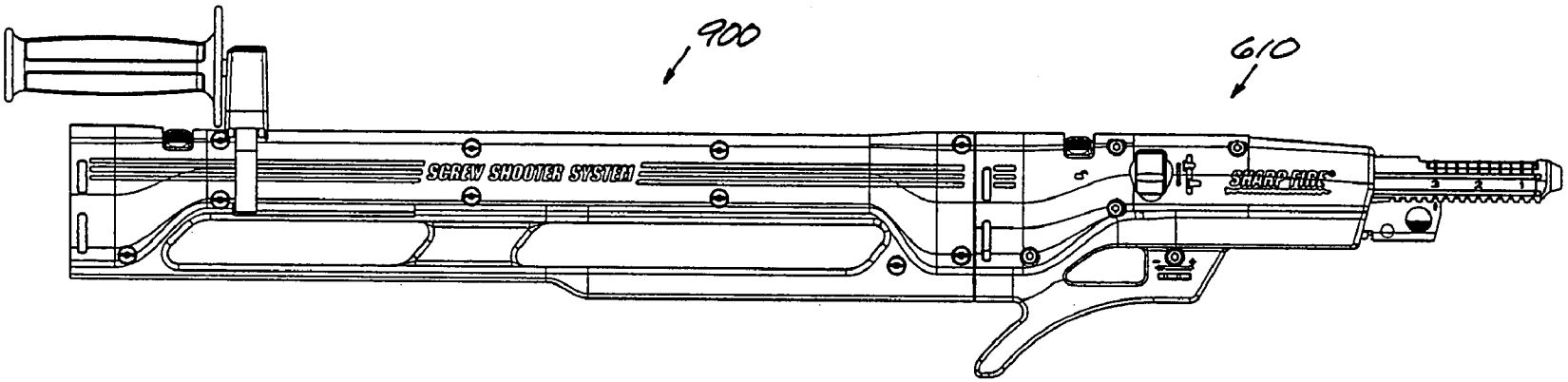
FIG. 36 is a view similar to FIG. 35 showing the device removed from the power tool.
Figure 37:
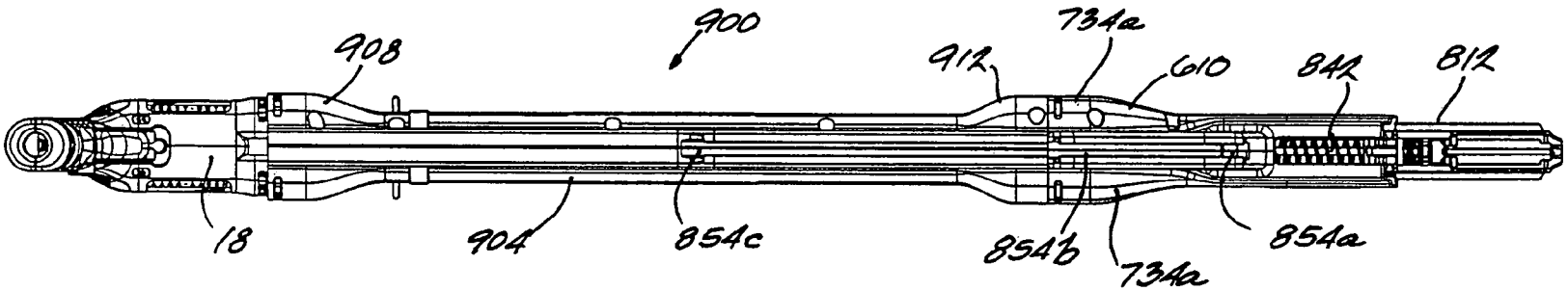
FIG. 37 is a bottom view of the fastener feeding device of FIG. 29.
Figure 38:
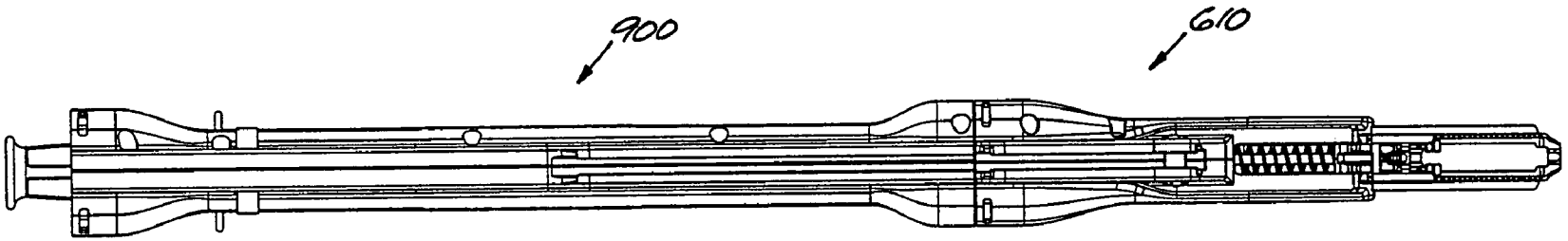
FIG. 38 is a view similar to FIG. 37 showing the device removed from the power tool.
Figure 32:
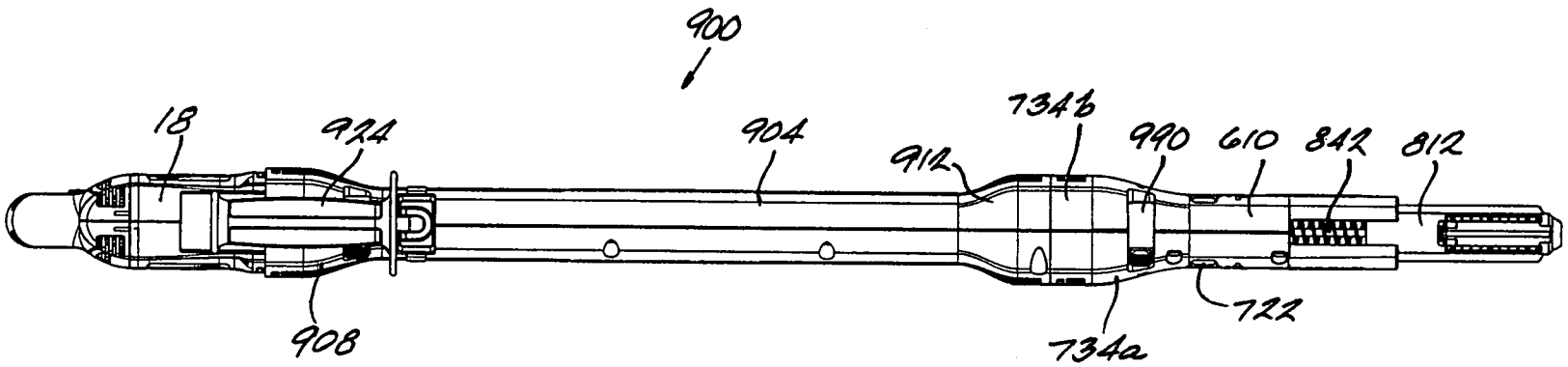
Figure 40:
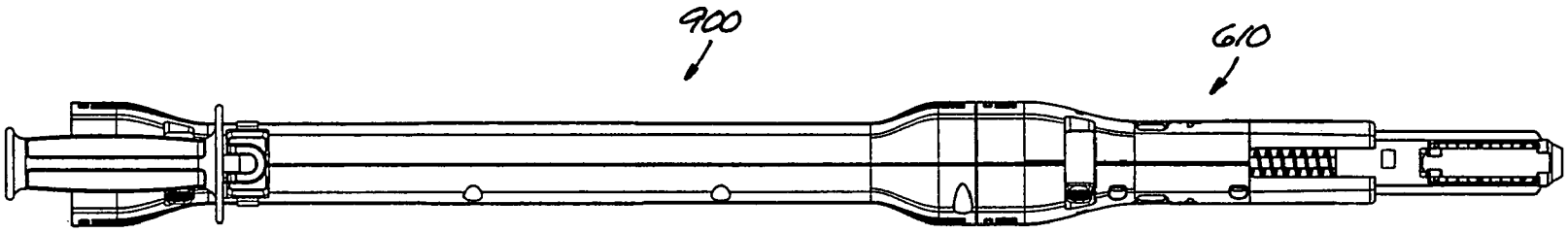
FIG. 40 is a view similar to FIG. 39 showing the device removed from the power tool.
Figure 41:
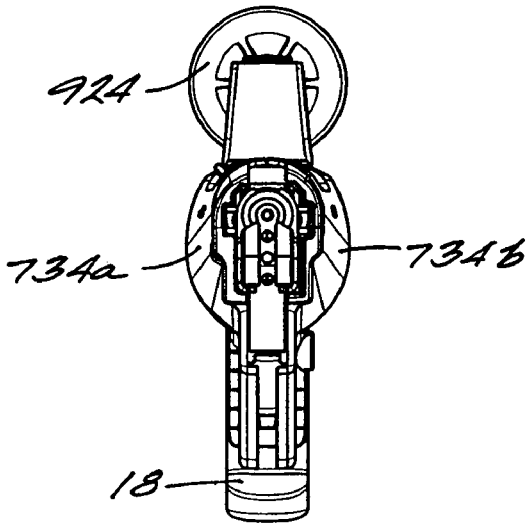
FIG. 41 is a front end view of the fastener feeding device of FIG. 29.
Figure 42:
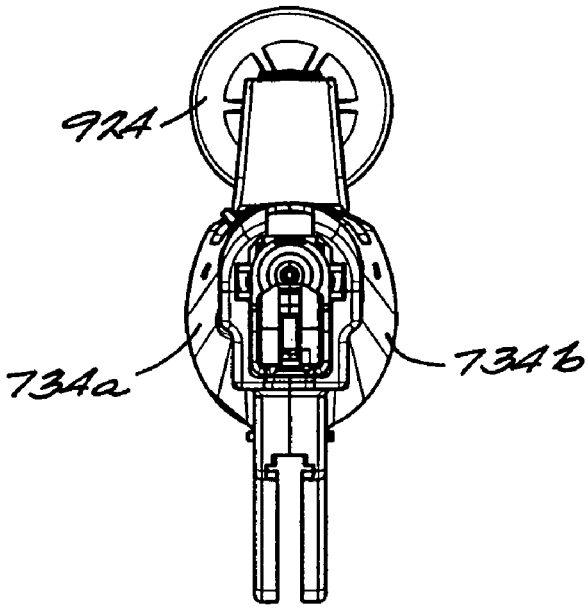
FIG. 42 is a view similar to FIG. 41 showing the device removed from the power tool.
Figure 43:
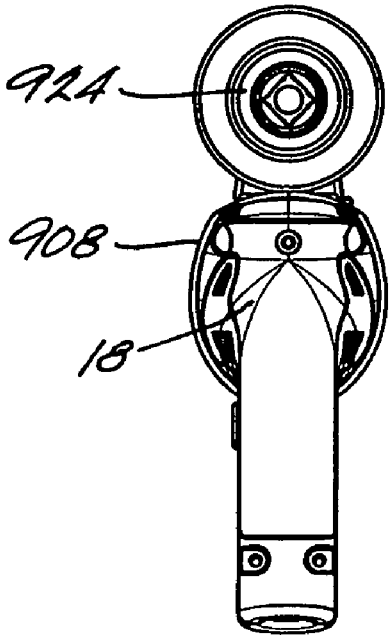
FIG. 43 is a rear end view of the fastener feeding device of FIG. 29.
Figure 44:
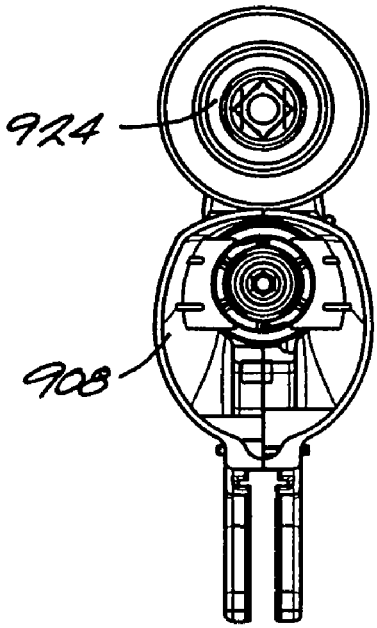
FIG. 44 is a view similar to FIG. 43 showing the device removed from the power tool.
Figure 45:
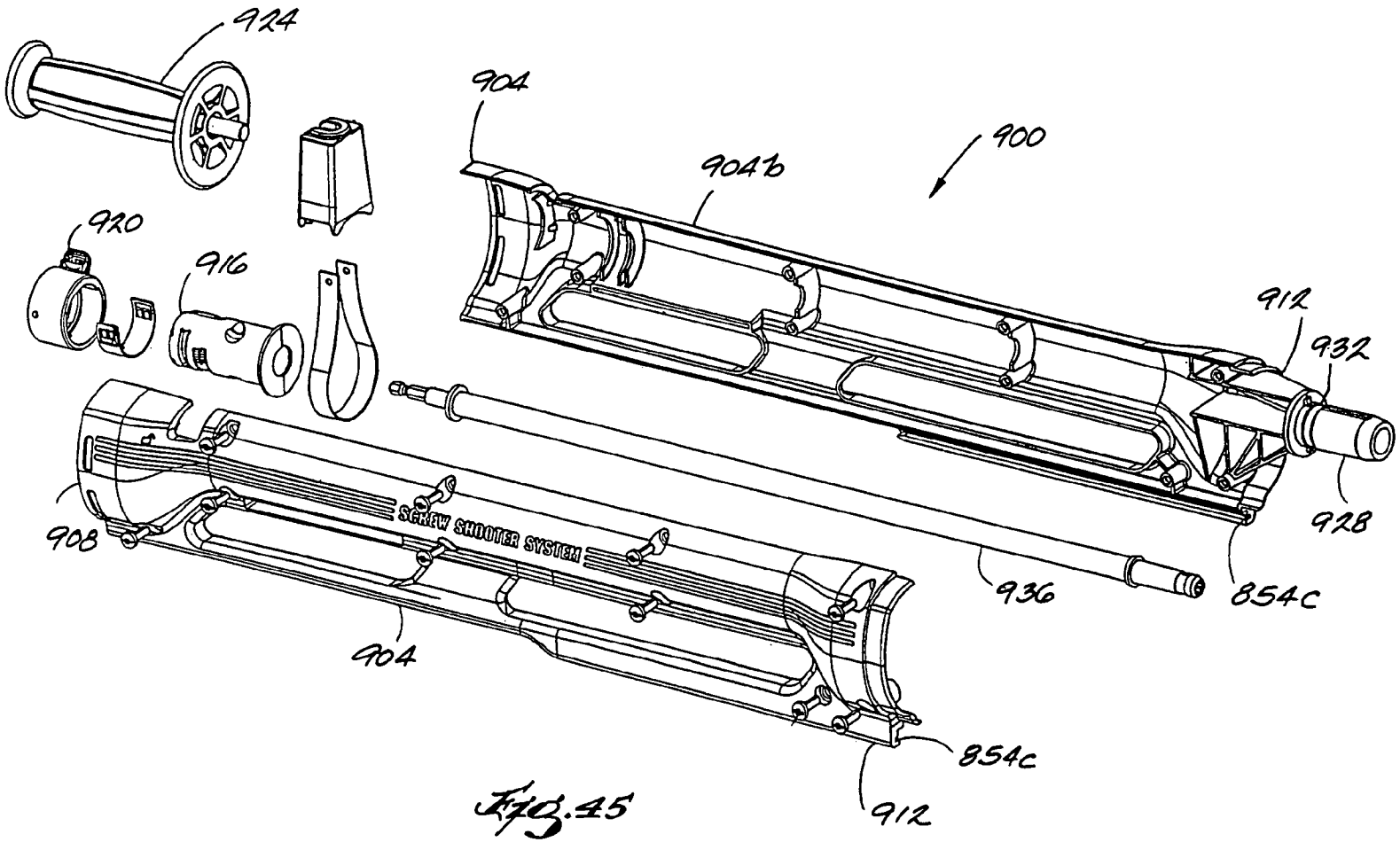
FIG. 45 is an exploded perspective view of the fastener feeding device of FIG. 29.

The strip 258 is illustrated in further detail in FIGS. 10 and 11. The strip 258 includes side notches 271 that receive the projections 200 of the starwheel 192. The strip 258 is incrementally advanced upon rotation of the starwheel 192 in response to axial movement of the glider assembly 150 and the depth control nose 212.

In operation, the device 10 is coupled to the tool 18 by guiding the device 10 along the tool axis 26 until the support projection 22 is received by the cavity 52 of the mounting sleeve 46. The cam projections 45 are aligned with the recesses 58, and the locking collar 90 is rotated about the tool axis 26 to the locked position, thereby urging the clamping blocks 110 radially inwardly until they are received by the circumferential groove 42. With the clamping blocks 110 snugly engaged with the recessed surface 44, the device 10 is securely coupled to the tool 18.

A fastener size is selected and the depth control nose 212 is moved with respect to the glider assembly 150 such that the distance between the starwheels 192 and the annular end surface 216 generally corresponds to the length of the fastener, as indicated by alignment of the arrow 240 with an appropriate graduation mark 226. The locking member 234 is pivoted upwardly to engage the teeth 238 with the teeth 228 of the depth control nose 212, thereby preventing relative axial movement between the glider assembly 150 and the depth control nose 212.

The depth stop adjuster ring 122 can then be rotated to select the depth to which the fastener will be driven with respect to the surface of the workpiece. As mentioned above, rotation of the adjuster ring 122 moves the depth stop 74 axially with respect to the mounting sleeve 46. The position of the depth stop 74 determines the extent to which the glider assembly 150 and the depth control nose 212 can move rearwardly with respect to the housing 134 and also with respect to the end 246 of the bit member 242. Specifically, the rearward motion of the glider assembly 150 and the depth control nose 212 is limited by engagement of at least one of the glider assembly 150 and depth control nose 212 with the forward surface of the depth stop 74 when the glider assembly 150 and depth control nose 212 are moved rearwardly during a fastener driving operation.

To drive a fastener into the workpiece, a strip of collated fasteners is loaded into the glider assembly 150 such that a first fastener is positioned offset from the tool axis 26 and ready for advancement to a position substantially aligned with the tool axis. The end surface 216 of the depth control nose 212 is engaged with the workpiece, and the operator urges the power tool 18 toward the workpiece. As the power tool 18 moves toward the workpiece, the glider assembly 150 and the depth control nose 212 move rearwardly with respect to the housing 134 and the bit member 242. The follower pin 204 pivots the connecting arm 176 such that the starwheels 192 pivot about the pivot axis 158. Rotation of the individual starwheels 192 is prevented by the spring 208 such that the projections 200 on the starwheels 192 advance the collated fastener strip through the glider assembly 150, thereby aligning the first fastener with the tool axis 26.

After the first fastener is aligned with the tool axis 26, the end 246 of the bit member 242 engages the head of the first fastener and the first fastener is removed from the strip and urged toward the workpiece. As the tip of the first fastener engages the workpiece, a clutch assembly in the power tool 18 is engaged such that the bit member 242 is driveably coupled to the motor of the power tool. Activation of the power tool motor with the clutch assembly engaged drives the fastener into the workpiece. As the fastener is driven into the workpiece, the glider assembly 150 and the depth control nose 212 continue to move rearwardly with respect to the housing 134 until the depth control nose 212 and/or the glider assembly 150 abuts the depth stop 74. It should be appreciated that in some circumstances the power tool motor may be activated before the clutch is engaged, however the bit member 242 will not be rotated until such time as sufficient pressure is exerted on the workpiece to engage the clutch.

After the fastener is driven into the workpiece, the operator withdraws the power tool 18 from the workpiece. The glider assembly 150 and the depth control nose 212 are urged back toward the extended position by the spring 166, and a second screw is positioned offset with respect to the tool axis 26, such that subsequent engagement of the end surface 216 of the depth control nose 212 with the workpiece will move the second fastener into alignment with the tool axis 26 for an additional driving operation.

To remove the device 10 from the power tool 18, the locking collar 90 is moved to the unlocked position. Doing so creates clearance between the cam surfaces 106 of the locking collar 90 and the camming surfaces 114 of the clamping blocks 110. In this regard, the clamping blocks 110 are freely movable in a radial direction with respect to the mounting sleeve 46. As the device 10 is pulled axially away from the power tool 18, the chamfered edges 43 of the circumferential groove urge the clamping blocks 110 radially outwardly, thereby disengaging the clamping blocks 110 from the circumferential groove 42 and allowing the device 10 to be removed from the power tool 18.

FIG. 12 illustrates an alternative construction of a fastener feeding device 310 embodying independent aspects of the invention. Elements of the fastener feeding device 310 that are the same or similar to elements of the fastener feeding device 10 have the same reference number increased by three-hundred.

Generally, the operation and construction of the device 310 is similar to the operation and construction of the device 10. While the device 10 utilizes the detent collar 108 to provide detent engagement between the mounting sleeve 46 and the locking collar 90, the mounting sleeve 346 and the locking collar 390 have integrally formed structure providing detent engagement in the locked position. In addition, the depth control nose 512 includes guide ribs 520 having a generally rectangular cross-section, as opposed to the T-shaped cross section of the guide ribs 220.

FIGS. 13–28 illustrate another alternative construction of a fastener feeding device 610 embodying independent aspects of the invention and attached to a rotary power tool 18. The operating characteristics of the fastener feeding device 610 are substantially the same as those of the fastener feeding device 10. Elements of the fastener feeding device 610 that are the same or similar to elements of the fastener feeding device 10 have been given the same reference number increased by six-hundred.

As illustrated, the device 610 includes numbered adjustment graduation marks 826 that, in some constructions, coincide with commonly used standard fastener lengths. The device 610 also includes indicia 280 adjacent the adjusting aperture 742 to assist an operator in adjusting the depth stop adjusting ring 722. Icons 284*a*, 284*b* are provided on the housing portion 734*a*, 734*b* adjacent opposite ends of the locking aperture 738. The icons 284*a*, 284*b* indicate whether the locking collar 690 is in the locked or unlocked position, respectively. The contour of the housing portions 734*a*, 734*b* are selected to correspond to and to compliment the contours of the power tool 18.

The housing portions 734*a*, 734*b* cooperate to define a first slot 854*a* that receives the strip of screws 258 and extends generally parallel to the tool axis, and a second slot 854*b* that converges with the first slot 854*a* but curves away from the tool axis. Either slot 854*a*, 854*b* can receive and guide the strip of screws 258, however the use of a particular slot may be more desirable depending upon a particular application, as discussed further below.

FIGS. 29–45 illustrate the device 610 coupled to an extension 900, which is in turn coupled to the power tool 18. The extension 900 is provided to increase an operator's reach for certain screw-driving applications. For example, when driving screws into a floor, the extension 900 can be used such that the operator may remain standing upright during the screw driving operations.

The extension 900 includes a housing 904 having a first end 908 that attaches to the power tool 18 and a second end 912 that, in the illustrated construction, attaches to the device 610. The first end 908 is configured similarly to the housing portions 734*a*, 734*b* and includes a locking aperture 916 and a locking collar 920 that operate in a similar manner as the locking aperture 138 and locking collar 90 to couple the first end 908 to the power tool 18. The first end 908 may also include a handle 924 to improve operator control.

The second end 912 includes an extension nosepiece 928 configured similarly to the nosepiece 14 of the power tool 18 and is received by the housing portions 734*a*, 734*b* of the device 610. The device 610 is attached to the second end 912 by way of the locking collar 690 which, as discussed above, urges clamping blocks (similar to clamping blocks 110) into a circumferential groove 932 provided on the second end 912. A drive shaft 936 extends through the extension 900 and transmits rotary motion from the power tool 18 to the bit member 842 (FIGS. 17, 23, 37, and 39) of the device 610. Like the housing portions 734*a*, 734*b*, the contours of the housing 904 is selected to correspond to and compliment the contours of the power tool 18.

The housing 904 also defines a third slot 854*c* that extends substantially parallel to the tool axis and that is aligned with the first slot 854*a* when the device 610 is coupled to the extension 900. The slot 854*c* receives and guides the strip of screws 258 during screw-driving operations. The slot 854*c* allows longer individual strips of screws 258 to be used and reduces the likelihood of the strip of screws 258 becoming tangled or catching on the workpiece.

Although the extension 900 is illustrated in use with the device 610, it should be appreciated that the extension 900 or alternate constructions of the extension 900 can also be configured for use with the devices 10 and 310, as well as with additional fastener feeding devices not necessarily illustrated or discussed herein.

Figure 46:
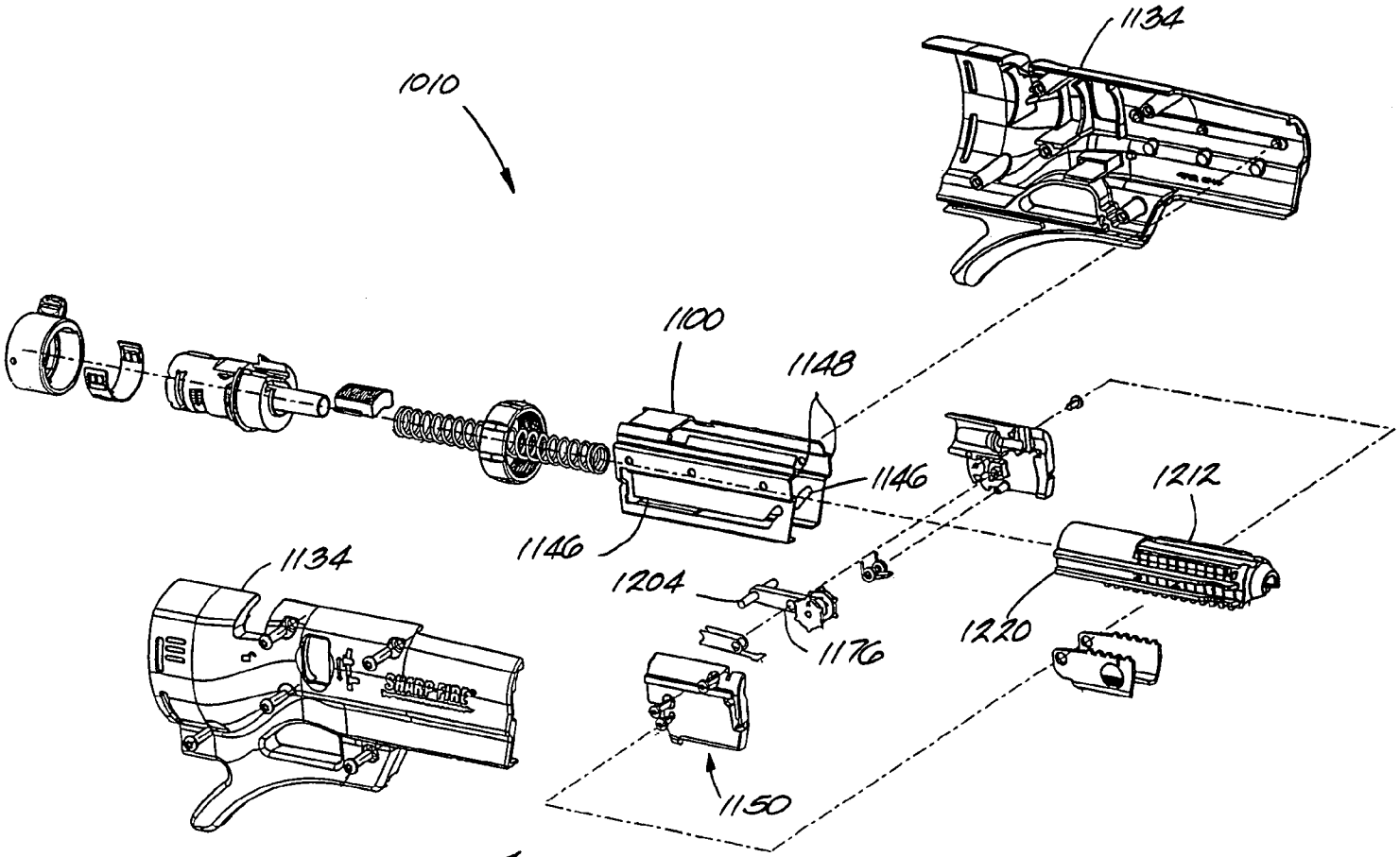
FIG. 46 is a perspective view of a further alternative construction of a fastener feeding device.

FIG. 46 illustrates another alternative construction of a fastener feeding device 1010 embodying independent aspects of the invention and attached to a rotary power tool 18. The operating characteristics of the fastener feeding device 1010 are substantially the same as those of the fastener feeding device 10. Elements of the fastener feeding device 1010 that are the same or similar to elements of the fastener feeding device 10 have been given the same reference number increased by one thousand.

As shown in FIGS. 2–4, the housing 134 defines the advancing slots 146 and the groove 148. The follower pin 204 of the glider assembly 150 is received by the advancing slots 146 and the guide ribs 220 of the depth control nose 212 are slidably received by the groove 148.

Generally, the operation and construction of the device 1010 is similar to the operation and construction of the device 10. In the construction shown in FIG. 46, the device 1010 includes a track portion 1100 supported by the housing 1134 that defines an advancing slot 1146 and a groove 1148. The track portion 1100 is connectable to the housing 1134 and is substantially disposed within the housing 1134 when the device 1010 is assembled. The device 101 includes a glider assembly 1150, similar to the glider assembly 150 described above, including a screw advancing assembly 1172 having a connecting arm 1176 and a follower pin 1204 coupled to an end of the connecting arm 1176. The follower pin 1204 is received by the advancing slots 1146 in the track portion 1100 and movement of the glider assembly pivots the connecting arm 1176 due to engagement of the follower pin 1204 with the angled portions of the advancing slots 1146.

The device 1010 includes a depth control nose 1212 coupled to and selectively slidably movable with respect to the glider assembly 1150. The depth control nose 1212 includes radially outwardly extending guide ribs 1220 that are slidably received by the grooves 1148 of the track portion 1100 for guiding the depth control nose 1212 along the tool axis.

Figure 47:
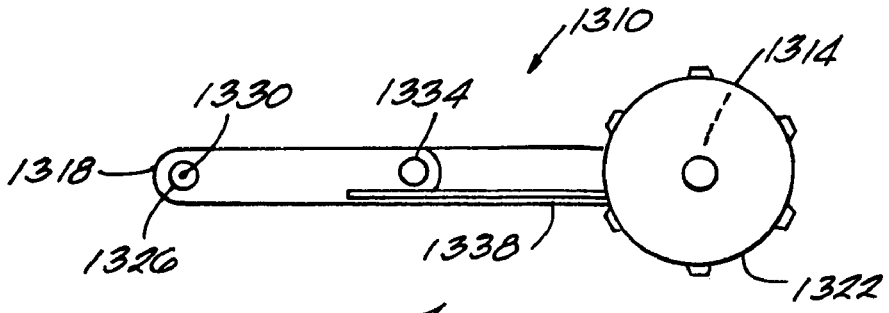
FIG. 47 is a side view of an alternative construction of a portion of a fastener feeding device.

FIG. 47 illustrates an alternative construction of a connecting arm 1310 for a glider assembly. As shown in FIGS. 2–4, the connecting arm 176 of the advancing assembly 172 is pivotally supported by the glider assembly 150. The pivot axis 158 passes through a central aperture 184 near the middle of the connecting arm 176. A starwheel 192 is coupled is coupled to the first end 180 of the connecting arm and a follower pin 204 is coupled to the second end 182. The follower pin 204 is received by the advancing slots 146 in the housing 134.

In the alternative construction shown in FIG. 47, the connecting arm 1310 extends from a first end 1314 to a second end 1318. At least one starwheel 1322 is rotatably coupled to the connecting arm 1310 adjacent the first end 1314 and may engage the collated strip of fasteners (see FIG. 5). A pivot aperture 1326 extends through the connecting arm 1310 adjacent the second end 1318 and may receive pivot pins of the glider assembly. The connecting arm 1310 may pivot about a pivot axis 1330 extending through the pivot aperture 1326. A follower pin 1334 is coupled to the connecting arm 1310 between the pivot aperture 1326 and the first end 1314. In FIG. 47, the follower pin 1334 is positioned near the center of the connecting arm 1310. The connecting arm 1310 may include a cantilevered spring 1338 to regulate movement of the starwheel 1322.

Figure 48:
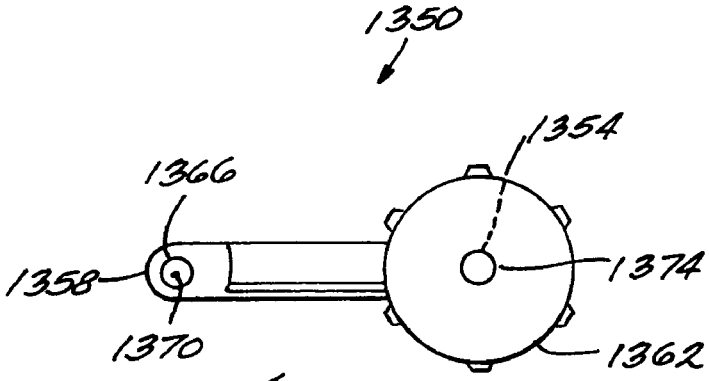
FIG. 48 is a side view of another alternative construction of a portion of a fastener feeding device.
Figure 49:
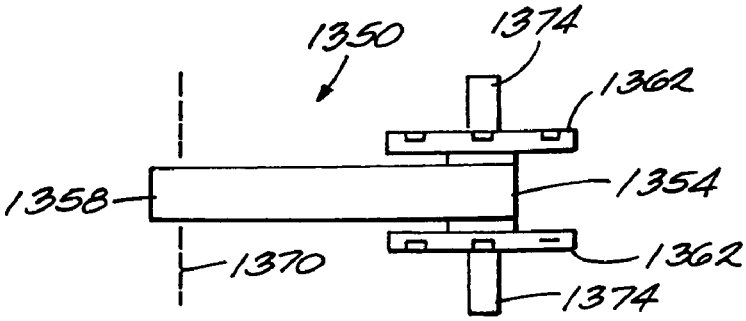
FIG. 49 is a top of the portion of the fastener feeding device of FIG. 48.

FIGS. 48–49 illustrate another alternative construction of a connecting arm 1350 extending from a first end 1354 to a second end 1358. At least one starwheel 1362 is rotatably coupled to the connecting arm 1350 adjacent the first end 1354 and may engage the collated strip of fasteners (see FIG. 5). A pivot aperture 1366 extends through the connecting arm 1350 adjacent the second end 1358 and may receive pivot pins that pivotally couple the connecting arm 1350 to the glider assembly. The connecting arm 1350 may pivot about a pivot axis 1370 extending through the pivot aperture 1366. A follower pin 1374 is coupled to the connecting arm 1350 adjacent the first end 1354. In FIGS. 48–49, the follower pin 1374 extends through the starwheels 1362 and may also be the axle for the starwheels 1362.

In the connecting arm 172 shown in FIGS. 2–4, the starwheel 192 and the follower pin 204 are positioned on opposite sides of the aperture 184 and pivot axis 158 from one another and the advancing slot 146 angles upwardly near an end of the slot 146. In the alternative constructions shown in FIGS. 47–49, the starwheels 1322, 1362 and the follower pins 1334, 1374 are both positioned on the same side of the pivot apertures 1326, 1366 and pivot axes 1330, 1370. For these constructions, the advancing slot may be reconfigured to provide a desired pivotal movement of the connecting arms 1310, 1350.

Figure 50:
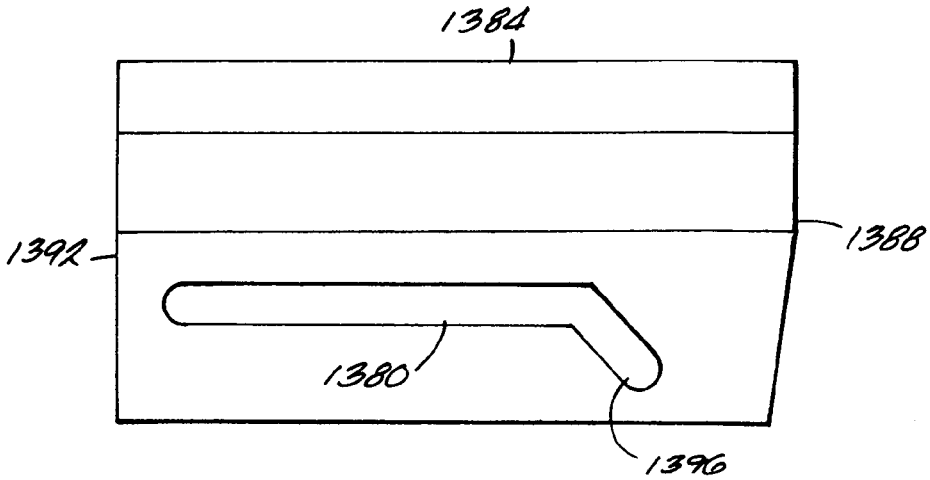
FIG. 50 is a side view of yet another alternative construction of a portion of a fastener feeding device.

FIG. 50 illustrates an alternative construction of an advancing slot 1380 for receiving the follower pins 1334, 1374 of the connecting arms 1310, 1350 shown in FIGS. 47–49. The advancing slot 1380 may be defined by a track portion 1384, similar to the track portion 1100 and advancing slot 1146 shown in FIG. 46, or may be defined by the housing, similar to the housing 134 and advancing slot 146 shown in FIGS. 2–4.

As shown in FIGS. 48–50, the track portion 1384 includes a first end 1388 facing away from the power tool and a second end 1392 facing toward the power tool. The advancing slot 1380 extends generally straight from the second 1392 toward the first end 1388 and has an angled portion 1396 angling downwardly adjacent the first end 1388. The follower pin 1374 is disposed in the angled portion 1396 and follows the advancing slot 1380 out of the angled portion 1396 and toward the second end 1392 as the power tool is advanced toward the workpiece. This movement of the follower pin 1374 pivots the starwheel 1374 upwardly with respect to the pivot axis 1370 and advances the collated strip of fasteners (see FIG. 5) through the feeding device. As the power tool is withdrawn from the work piece, the follower pin 1374 moves toward the first end 1388 and returns to the angled portion 1396, thereby pivoting the starwheel 1374 downwardly to engage the next portion of the collated strip of fasteners (see FIG. 5). The shape of the advancing slot 1380 may be formed to accommodate other configurations of the connecting arm to provide a desired movement of the connecting arm and advancing assembly.

Figure 51:
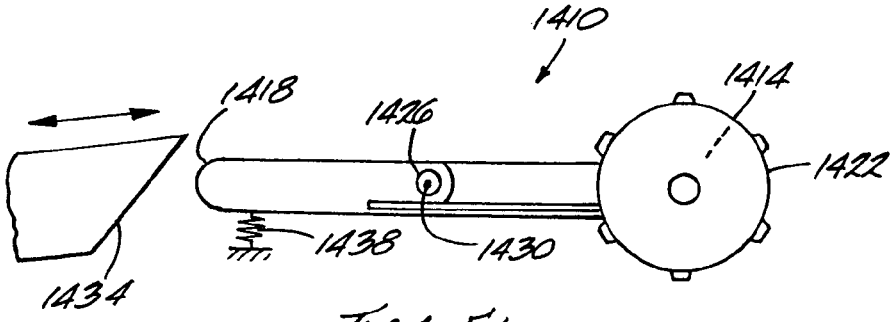
FIG. 51 is a side view of a further alternative construction of a portion of a fastener feeding device.

FIG. 51 illustrates another alternative construction of a connecting arm 1410 extending from a first end 1414 to a second end 1418. A starwheel 1422 is rotatably coupled to the connecting arm 1410 adjacent the first end 1414 and may engage the collated strip of fasteners (see FIG. 5). A pivot aperture 1426 extends through the connecting arm 1410 near the middle of the connecting arm 1410 and may receive pivot pins that pivotally couple the connecting arm 1410 to the glider assembly. The connecting arm 1410 may pivot about a pivot axis 1430 extending through the pivot aperture 1410.

The connecting arm 1410 is similar to the connecting arm 172 shown in FIGS. 2–4, but the connecting arm 1410 incorporates a different means of actuating the connecting arm 1410. In FIGS. 2–4, the follower pin 204 is received by the advancing slot 146. In FIG. 51, an angled advancing cam 1434 engages the second end 1418 of the connecting arm 1410 to pivot the connecting arm 1410. The advancing cam 1434 may be fixed with respect to the housing and the connecting arm 1410 may be pivotally coupled to a glider assembly slidably movable with respect to the housing. As the connecting arm 1410 moves toward the advancing cam 1434, the advancing cam 1434 engages the second end 1410 to pivot the connecting arm 1410 downwardly about the pivot axis 1430 which in turn pivots the starwheel 1422 upwardly. The connecting arm 1410 may include a biasing member 1438, such as a spring, to bias the second end 1418 against the advancing cam 1434.

Figure 52:
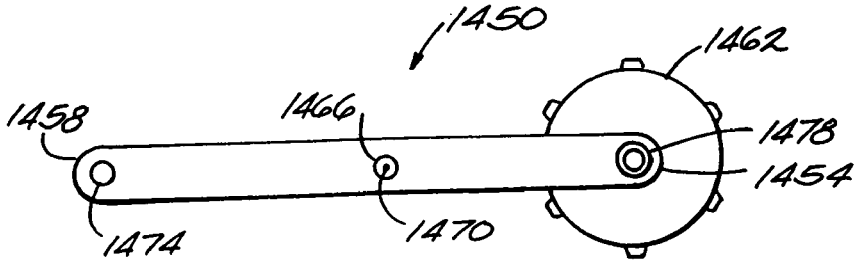
FIG. 52 is a side view of another alternative construction of a portion of a fastener feeding device.

FIG. 52 illustrates a partial cut-away view of another alternative construction of a connecting arm 1450 extending from a first end 1454 to a second end 1458. A starwheel 1462 is rotatably coupled to the connecting arm 1450 adjacent the first end 1454 and may engage the collated strip of fasteners (see FIG. 5). A pivot aperture 1466 extends through the connecting arm 1450 near the middle of the connecting arm 1450 and may receive pivot pins that pivotally couple the connecting arm 1450 to the glider assembly. The connecting arm 1450 may pivot about a pivot axis 1470 extending through the pivot aperture 1450. A follower pin 1474 is coupled to the connecting arm 1450 adjacent the second end 1458.

The connecting arm 1450 is similar to the connecting arm 172 shown in FIGS. 2–4, but the connecting arm 1450 incorporates a different means of restricting rotation of the starwheel 1462. In FIGS. 2–4, the cantilevered spring 208 engages a ratchet portion of the starwheels 192 to limit rotation of the starwheels 192 in only one direction. In FIG. 52, the starwheel 1462 is rotatably coupled to the connecting arm 1450 with a one-directional roller bearing 1478, or sprag clutch, that only permits rotation of the starwheel 1462 with respect to the connecting arm 1450 in one direction.

Figure 53:
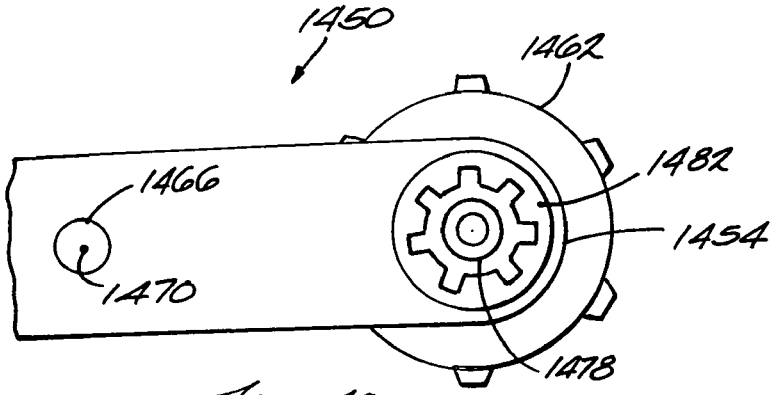
FIG. 53 is a side view of yet another alternative construction of a portion of a fastener feeding device.

FIG. 53 illustrates an alternative construction of the connecting arm 1450 shown in FIG. 52. In FIG. 53, a splined wheel 1482 couples the one-directional roller bearing 1478 to the connecting arm 1450 to permit additional play between the starwheel 1462 and the connecting arm 1450. The spine wheel 1482 may include two interconnecting spline portions, with an outer portion having spline teeth projecting radially inwardly and an inner portion having spline teeth projecting radially outwardly. The one-directional roller bearing 1478 only permits rotation of the starwheel 1462 in one direction, but slight rotation or movement of the starwheel 1462 in the opposite direction may be desirable to align the starwheel 1462 with the collated strip of fasteners (see FIG. 5). In some aspects and in some constructions, the spline wheels 1482 may be coupled between the starwheels 1462 and the one-directional roller bearing 1478.

Figure 54:
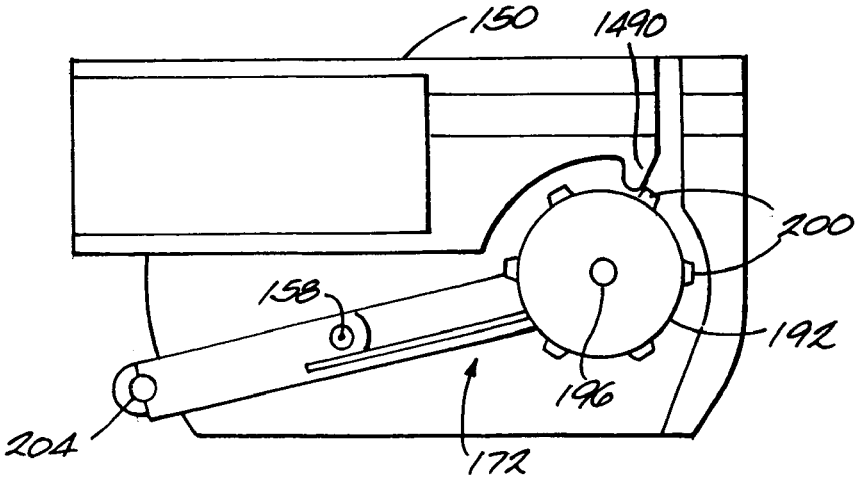
FIG. 54 is a side view of a further alternative construction of a portion of a fastener feeding device.

FIG. 54 illustrates an alternative construction of the glider assembly 150 shown in FIGS. 2–4. A connecting arm 172 pivotally coupled to the glider assembly 150 to pivot about a pivot axis 158. As described above, the follower pin 204 follows an advancing slot 146 to pivot the connecting arm 172. The starwheel 192 generally advances the collated strip of fasteners (see FIG. 5) through the device as the starwheel 192 pivots upwardly and rotation of the starwheel 192 is prevented. As the starwheels 192 pivots downwardly, the starwheel 192 rotates with respect to the connecting arm 172 and the projections 200 of the starwheel 192 are received by the next side notches 271 (FIG. 10) of the strip 258 (FIG. 10) to incrementally advance the next fastener through the device.

As shown in FIG. 54, the glider assembly 150 includes a boss 1490 adjacent the starwheel 192. The projections 200 of the starwheel 192 engage notches 271 (FIG. 10) of the collated fastener strip 258 (FIG. 10) to advance the strip 258 (FIG. 10) through the device. The boss 1490 is fixed with respect to the glider assembly 150 and engages the projections 200 of the starwheel 192 to properly align the fastener from the collated strip 258 (FIG. 10) with the tool axis. The boss 1490 limits movement of the connecting arm 172 and starwheel 192 in an upwardly direction. The boss 1490 also helps align the projections 200 with the next notches 271 (FIG. 10) as the starwheel 192 rotates to engage the next fastener.

One or more independent features or independent advantages of the invention may be set forth in the following claims:

We claim:

1. A fastener feeding device for a power tool, the power tool including a support projection defining a tool axis and a groove extending at least partially around the circumference of the support projection, said device comprising:

a feed device including a mounting sleeve selectively connectable with the support projection, a clamping block supported by the mounting sleeve and radially movable relative to the tool axis, the clamping block being engageable with the groove, and an actuator operable to move the clamping block into engagement with the groove, the actuator being engageable by a hand of an operator, the actuator being movable between a locked condition, in which the clamping block is at least partially disposed within the groove to resist axial movement of the mounting sleeve relative to the support projection, and an unlocked condition, in which the clamping block is allowed to move from the groove such that the mounting sleeve is removable from the support projection.

2. The device of claim 1 and further comprising an extension connectable between the support projection and the mounting sleeve and operable to support the feed device on the power tool, the extension including an extension housing connectable with the support projection, a tool-less locking assembly operable to selectively lock the extension to the power tool, and an extension projection connectable with mounting sleeve and defining an extension groove, the clamping block being engageable with the extension groove to resist axial movement of the mounting sleeve relative to the extension projection.

3. The device of claim 2 wherein the locking assembly includes an extension clamping block supported by the extension housing and radially movable relative to the tool axis, the extension clamping block being engageable with the groove of the support projection, and an extension actuator operable to move the extension clamping block into engagement with the groove of the support projection, the extension actuator being engageable by a hand of an operator, the extension actuator being movable between a locked condition, in which the extension clamping block is at least partially disposed within the groove to resist axial movement of the extension housing relative to the support projection, and an unlocked condition, in which the extension clamping block movable from the groove such that the extension housing is removable from the support projection.

4. The device of claim 1 where the feed device further includes a locking collar at least partially surrounding the mounting sleeve and rotatable about the tool axis between a locked position, in which the locking collar urges the clamping block into engagement with groove, and an unlocked position, in which the clamping block is allowed to move out of engagement with the groove, the actuator being operable to move the locking collar between the locked position and the unlocked position.

5. The device of claim 4 wherein the locking collar has a radially inwardly facing cam surface engaging the clamping block, the clamping block moving in a radially inward direction in response to rotation of the locking collar in a first direction.

6. The device of claim 1 wherein the power tool includes an abutting face adjacent the support projection, and wherein the mounting sleeve has an end surface engageable with the abutting surface.

7. The device of claim 6 wherein one of the abutting face and the end surface includes a projection, and wherein the other of the abutting face and the end surface defines a recess for receiving the projection.

8. The device of claim 7 wherein engagement of the projection and the recess restricts rotational movement of the mounting sleeve relative to the support projection.

9. The device of claim 8 wherein engagement of the projection and the recess substantially prevents rotational movement of the mounting sleeve relative to the support projection.

10. The device of claim 7 wherein rotation of the mounting sleeve relative to the support projection and engagement of the projection and the recess causes axial movement of the mounting sleeve relative to the support projection.

11. The device of claim 10 wherein, in the unlocked condition, axial movement of the mounting sleeve relative to the support projection causes radially outward movement of the clamping block relative to the support projection.

12. The device of claim 1 wherein the groove includes a circumferential groove extending around the support projection, wherein said device further comprises a second clamping block supported by the mounting sleeve circumferentially spaced from the first-mentioned clamping block, the second clamping block being radially movable relative to the tool axis and being engageable with the groove, and wherein the actuator is operable to move the second clamping block into engagement with the groove.

13. A fastener feeding device for a power tool, the power tool including a support projection defining a tool axis and a groove extending at least partially around the circumference of the support projection, said device comprising:

a feed device including a device housing, and a feed assembly operable to feed a fastener to a driving position; and an extension connectable between the support projection and the device housing and operable to support the feed device on the power tool, the extension including an extension housing connectable with the support projection, a tool-less locking assembly operable to selectively lock the extension to the power tool, and an extension support connectable with and operable to support the device housing.

14. The device of claim 13 wherein the locking assembly includes an extension clamping block supported by the extension housing and radially movable relative to the tool axis, the extension clamping block being engageable with the groove of the support projection, and an extension actuator operable to move the extension clamping block into engagement with the groove of the support projection, the extension actuator being engageable by a hand of an operator, the extension actuator being movable between a locked condition, in which the extension clamping block is at least partially disposed within the groove to resist axial movement of the extension housing relative to the support projection, and an unlocked condition, in which the extension clamping block movable from the groove such that the extension sleeve is removable from the support projection.

15. The device of claim 14 wherein the extension further includes an extension locking collar at least partially surrounding the extension housing and rotatable about the tool axis between a locked position, in which the extension locking collar urges the extension clamping block into engagement with groove, and an unlocked position, in which the extension movable out of engagement with the groove, the extension actuator being operable to move the extension locking collar between the locked position and the unlocked position.

16. The device of claim 15 wherein the extension locking collar has a radially inwardly facing cam surface engaging the extension clamping block, the clamping block moving in a radially inward direction in response to rotation of the extension locking collar in a first direction.

17. The device of claim 13 wherein the power tool includes an abutting face adjacent the support projection, and wherein the extension housing has an end surface engageable with the abutting surface.

18. The device of claim 17 wherein one of the abutting face and the end surface includes a projection, and wherein the other of the abutting face and the end surface defines a recess for receiving the projection.

19. The device of claim 18 wherein engagement of the projection and the recess restricts rotational movement of the extension housing relative to the support projection.

20. The device of claim 19 wherein engagement of the projection and the recess substantially prevents rotational movement of the extension housing relative to the support projection.

21. The device of claim 18 wherein rotation of the mounting sleeve relative to the support projection and engagement of the projection and the recess causes axial movement of the extension housing relative to the support projection.

22. The device of claim 21 wherein the locking assembly includes an extension clamping block supported by the extension housing and radially movable relative to the tool axis, the extension clamping block being engageable with the groove of the support projection, the extension clamping block having a locked condition, in which the extension clamping block is at least partially disposed within the groove to resist axial movement of the extension housing relative to the support projection, and an unlocked condition, in which the extension clamping block is movable from the groove such that the extension housing is removable from the support projection, and wherein, in the unlocked condition, axial movement of the extension housing relative to the support projection causes radially outward movement of the extension clamping block relative to the support projection.

23. The device of claim 13 wherein the extension support defines an extension groove extending at least partially around the circumference of the extension support, and wherein the feed device includes a mounting sleeve selectively connectable with the extension support, a feed device clamping block supported by the mounting sleeve and radially movable, the feed device clamping block being engageable with the extension groove to resist axial movement of the mounting sleeve relative to the extension support.

24. The device of claim 23 wherein, when the extension is disconnected from the support projection, the mounting sleeve is selectively connectable with the support projection to support the feed device on the support projection.

25. The device of claim 24 wherein, when the feed device is supported on the support projection, the feed device clamping block is engageable with the groove to resist axial movement of the mounting sleeve relative to the support projection.

26. The device of claim 13 wherein the extension includes an extension abutting face adjacent the extension support, and wherein the device housing has a housing end surface engageable with the extension abutting surface.

27. The device of claim 26 wherein one of the extension abutting face and the housing end surface includes a projection, and wherein the other of the extension abutting face and the housing end surface defines a recess for receiving the projection.

28. The device of claim 27 wherein engagement of the projection and the recess restricts rotational movement of the device housing relative to the extension support.

29. The device of claim 28 wherein engagement of the projection and the recess substantially prevents rotational movement of the device housing relative to the extension support.

30. The device of claim 27 wherein rotation of the device housing relative to the extension support and engagement of the projection and the recess causes axial movement of the device housing relative to the extension support.

31. The device of claim 30 wherein the extension support defines an extension groove extending at least partially around the circumference of the extension support, wherein the feed device includes a device clamping block supported by the device housing and radially movable, the device clamping block being engageable with the extension groove, the device clamping block having a locked condition, in which the device clamping block is at least partially disposed within the extension groove to resist axial movement of the device housing relative to the extension support, and an unlocked condition, in which the device clamping block is movable from the extension groove such that the device housing is removable from the extension support, and wherein, in the unlocked condition, axial movement of the device housing relative to the extension support causes radially outward movement of the device clamping block relative to the extension support.

* * * * *